US012799552B2

(12) United States Patent
Rohatgi et al.

(10) Patent No.: US 12,799,552 B2
(45) Date of Patent: Nov. 17, 2026

(54) ALUMINUM SHEET PROCESSING, ALUMINUM COMPONENT PROCESSING, AND ALUMINUM COMPONENTS

(71) Applicant: Battelle Memorial Institute, Richland, WA (US)

(72) Inventors: Aashish Rohatgi, Richland, WA (US); Richard W. Davies, Lenoir City, TN (US); Mert Efe, West Richland, WA (US); Wahaz Nasim, Boston, MA (US); Angel Ortiz, Pasco, WA (US); Piyush Upadhyay, Richland, WA (US); Hrishikesh Das, Richland, WA (US); Glenn J. Grant, Benton City, WA (US); Elizabeth V. Stephens, Kennewick, WA (US)

(73) Assignee: Battelle Memorial Institute, Richland, WA (US)

( * ) Notice: Subject to any disclaimer, the term of this patent is extended or adjusted under 35 U.S.C. 154(b) by 23 days.

(21) Appl. No.: 18/126,018

(22) Filed: Mar. 24, 2023

(65) Prior Publication Data

US 2023/0304114 A1 Sep. 28, 2023

Related U.S. Application Data

(60) Provisional application No. 63/323,428, filed on Mar. 24, 2022.

(51) Int. Cl.
*C21D 8/02* (2026.01)
*C21D 8/0221* (2026.01)

(52) U.S. Cl.
CPC ..... *C21D 8/0236* (2013.01)

(58) Field of Classification Search
None
See application file for complete search history.

(56) References Cited

U.S. PATENT DOCUMENTS 7,290,423 B2 11/2007 Carsley et al.
8,105,449 B2 1/2012 Yoshinda et al.
(Continued)

OTHER PUBLICATIONS

Totten, George E, et al. Handbook of Quenchants and Quenching Technology. ASM International, 1993, pp. 129-139. (Year: 1993).*
(Continued)

*Primary Examiner* — Anthony M Liang
(74) *Attorney, Agent, or Firm* — Wells St. John P.S.

(57) ABSTRACT

Aluminum sheet stamping processes are provided that can include heating an aluminum sheet to a first temperature that is greater than ambient temperature; quenching the aluminum sheet to cool the aluminum sheet to a second temperature that is less than the first temperature; after the quenching allowing the aluminum sheet to rest at ambient temperature for at least 24 hours; and stamping the aluminum sheet to form a stamped component. Stamped aluminum components including one or more portions having an HRB hardness of greater than 87 are also provided.

Processes are also provided for fabricating an aluminum component from an aluminum sheet. The processes can include modifying formability of at least one discrete portion of an aluminum sheet, and compressing and/or expanding at least a portion of the one discrete portion to form a fabricated component. The fabricated component can include at least one aluminum member comprising a compressed and/or expanded modified discrete portion.

16 Claims, 28 Drawing Sheets
(15 of 28 Drawing Sheet(s) Filed in Color)

(56) References Cited

U.S. PATENT DOCUMENTS

| | | | |
|---|---|---|---|
| 9,783,865 | B2 | 10/2017 | Sachdev et al. |
| 10,343,726 | B2 | 7/2019 | Smeyers et al. |
| 10,344,364 | B2 | 7/2019 | Bassi et al. |
| 10,661,646 | B2 | 5/2020 | Matecki et al. |
| 10,695,811 | B2 | 6/2020 | Joshi et al. |
| 11,045,851 | B2 | 6/2021 | Joshi et al. |
| 2001/0004910 | A1 | 6/2001 | Yasuhara et al. |
| 2005/0284204 | A1 | 12/2005 | Carsley et al. |
| 2009/0019908 | A1 | 1/2009 | Stangl |
| 2017/0101704 | A1 | 4/2017 | Bassi et al. |
| 2019/0193130 | A1 | 6/2019 | McNulty |

OTHER PUBLICATIONS

"Solution Heat Treatment of Aluminum ." L&L Special Furnace Co, Inc., Feb. 5, 2021, llfurnace.com/blog/solution-heat-treatment-of-aluminum/. (Year: 2021).*

Abu-Farha et al., "In-Situ Local Measurement of Austenite Mechanical Stability and Transformation Behavior in Third-Generation Advanced High-Strength Steels", Metallurgical and Materials Transactions A, vol. 49, 2018, United States, pp. 2583-2596.

Behrens et al., "Mechanical Properties and formability of EN AW-7075 in cold forming processes", IOP Conf. Series: Mater. Sci. Eng. 967 (2020) United Kingdom, 8 pages.

Berg et al., "GP-Zones in Al—Zn—Mg Alloys and Their Role in Artificial Aging", Acta Materialia, vol. 49, 2001, United Kingdom, pp. 3443-3451.

Buha et al., "Secondary ageing in an aluminum alloy 7050", Materials Science and Engineering A, 492, 2008, Netherlands, pp. 1-10.

Choi et al., "Advanced Micromechanical Model for Transformation-Induced Plasticity Steels with Application of In Situ High-Energy X-Ray Diffraction Method", Metallurgical and Materials Transactions A, vol. 39A, 2008, United States, pp. 3089-3096.

Choi et al., "Influence of various material design parameters on deformation behaviors of TRIP steels", Computational Materials Science, vol. 50 , 2010, Netherlands, pp. 720-730.

Deschamps et al., "In-situ evaluation of dynamic precipitation during plastic straining of an Al—Zn—Mg—Cu alloy", Acta Materialia, vol. 60, 2012, United Kingdom, pp. 1905-1916.

Dmitrieva et al., "Chemical gradients across phase boundaries between martensite and austenite in steel studied by atom probe tomography and simulation", Acta Materialia, vol. 59, 2011, United Kingdom, pp. 364-374.

Guo et al., "Enhanced bake-hardening response of an Al—Mg—Si—Cu alloy with Zn addition", Materials Chemistry and Physics, vol. 162, 2015, Netherlands, pp. 15-19.

Harrison et al., "Hot Stamping of a B-Pillar Outer from High Strength Aluminum Sheet AA7075", SAE International Journal of Materials and Manufacturing, vol. 7, Issue 3, 2014, United States, pp. 567-573.

Hutchinson et al., "Quantifying the strain-induced dissolution of precipitates in Al alloy microstructures using nuclear magnetic resonance", Acta Materialia, vol. 57, 2009, United Kingdom, pp. 5645-5653.

Karbasian et al., "A review on hot stamping", Journal of Materials Processing Technology, vol. 210, 2010, Netherlands, pp. 2103-2118.

Kearns et al., "MMLV: Automatic Transmission Lightweighting", SAE Technical Paper 2015-01-1240, 2015, United States, 11 pages.

Kumar et al., "Influence of temper on the performance of a high-strength Al—Zn—Mg alloy sheet in the warm forming processing chain", Journal of Materials Processing Technology, vol. 231, 2016, Netherlands, pp. 189-198.

Leacock et al., "Evolution of mechanical properties in a 7075 Al-alloy subject to natural ageing", Materials and Design, vol. 49, 2013, Netherlands, pp. 160-167.

Lee et al., "Determination of forming procedure by numerical analysis and investigation of mechanical properties of steel/CFRP hybrid composites with complicated shapes", Composite Structures, vol. 164, 2017, Netherlands, pp. 118-129.

Lee et al., "Mechanical Properties and Formability of Heat-Treated 7000-Series High-Strength Aluminum Alloy: Experiments and Finite Element Modeling", Metals and Materials International, vol. 26, 2020, South Korea, pp. 682-694.

Li et al., "Comparison of the hot-stamped boron-alloyed steel and the warm-stamped medium-Mn steel on microstructure and mechanical properties", Materials Science and Engineering A, 679, 2017, Netherlands, pp. 240-248.

Li et al., "Effects of process parameters on thickness thinning and mechanical properties of the formed parts in incremental sheet forming", The International Journal of Advanced Manufacturing Technology, vol. 98, 2018, United Kingdom, pp. 3071-3080.

Liu et al., "Flow and friction behaviors of 6061 aluminum alloy at elevated temperatures and hot stamping of a B-pillar", The International Journal of Advanced Manufacturing Technology, vol. 96, 2018, United Kingdom, pp. 4063-4083.

MacKenzie, "Metallurgy of Heat Treatable Aluminum Alloys", ASM Handbook, vol. 4E, 2016, United States, pp. 65-113.

Merklein et al., "A review on tailored blanks-Production, applications and evaluation", Journal of Materials Processing Technology, vol. 214 , 2014, Netherlands, pp. 151-164.

Merklein et al., "Hot stamping of boron steel sheets with tailored properties: A review", Journal of Materials Processing Technology, vol. 228, 2016, Netherlands, pp. 11-24.

Paraianu et al., "Modelling of the Forming Limit Diagrams Using the Finite Element Method", Advanced Methods in Material Forming, 2007, Germany, pp. 151-165.

Plourde et al., "MMLV: Door Design and Component Testing", SAE Technical Paper 2015-01-0409, 2015, United States, 10 pages.

Rader et al., "Retrogression Forming and Reaging of an AA7075-T6 Alclad Sheet Material", Journal of Materials Engineering and Performance, vol. 31, 2022, United States, pp. 5311-5323.

Reinstettel, "The Door Sidecars Beam in the New BMW i8: Application of a Press Hardened 7xxx Aluminum Alloy Panel", 5th International Conference on Accuracy in Forming Technology, ICAFT 2015, 2015, Germany, 9 pages.

Rohatgi et al., "An Investigation of enhanced formability in AA5182-O Al during high-rate free-forming at room temperature: Quantification of deformation history", Journal of Materials Processing Technology, vol. 214, 2014, Netherlands, pp. 722-732.

Rohatgi et al., "Electro-hydraulic forming of sheet metals: Free-forming vs. conical-die forming", Journal of Materials Processing Technology, vol. 212, 2012, Netherlands, pp. 1070-1079.

Rohatgi et al., "Experimental characterization of sheet metal deformation during electro-hydraulic forming", Journal of Materials Processing Technology, vol. 211, 2011, Netherlands, pp. 1824-1833.

Shih et al., "Optimal Production Trimming Process for AHSS Sheared Edge Stretchability Improvement", SAE Technical Paper, 2014-01-0994, 2014, United States, 9 pages.

Whalen et al., "Magnesium alloy ZK60 tubing made by Shear Assisted Processing and Extrusion (ShAPE)", Material Science and Engineering A 755 (2019), The Netherlands, pp. 278-288.

Yang et al., "Ferrite Recrystallization and Austenite Formation in Cold-Rolled Intercritically Annealed Steel", Metallurgical Transactions A, vol. 16A, 1985, United States, pp. 1385-1392.

Zhu et al., "Investigation on strengthening of 7075 aluminum alloy sheet in a new hot stamping process with pre-cooling", The International Journal of Advanced Manufacturing Technology, vol. 103, 2019, United Kingdom, pp. 4739-4746.

Abubakar et al., "Simulation of ship grounding damage using the finite element method", International Journal of Solids and Structures, vol. 50, 2013, Netherlands, pp. 623-636.

Behrens et al., "Influences on the formability and mechanical properties of 7000-aluminum alloys in hot and warm forming", Journal of Physics: Conference Series, 896 (012004), 2017, United States, 8 pages.

Billur et al., "R&D Update: Warm forming of alloys in the auto industry", available online at https://www.thefabricator.com/thefabricator/article/bending/warm-forming-of-alloys-in-the-auto-industry, 2013, 8 pages.

(56) References Cited

OTHER PUBLICATIONS

Chbihi et al., "Interactions between ferrite recrystallization and austenite formation in high-strength steels", Journal of Materials Science, vol. 49, 2014, Netherlands, pp. 3608-3621.
Dassault Systemes Corporation, "Abaqus 6.11", GIU Toolkit Reference Manual, 2011, United States, 517 pages.
Dumont et al., "On the relationship between microstructure, strength and toughness in AA7050 aluminum alloy", Materials Science and Engineering, A356, 2003, Netherlands, pp. 326-336.
Euro New Car Assessment, "Oblique Pole Side Impact Testing Protocol", Europe New Car Assessment Programme, 2015, 24 pages.
Fu et al., "Analytical modeling and numerical simulation for three-roll bending forming of sheet metal", International Journal of Advanced Manufacturing Technology, vol. 69, 2013, United Kingdom, pp. 1639-1647.
Gu et al., "Investigation on Fracture of a 6014-T4 Aluminum Alloy Sheet in the Flanging and Hemming Process Based on Numerical and Experimental Methods", Metals, vol. 10 (81), 2020, Switzerland, pp. 1-14.
Hu et al., "Edge fracture prediction of traditional and advanced trimming processes for AA6111-T4 sheets", Journal of Manufacturing Science and Engineering, vol. 136 (2) 2014, United States, 11 pages.
Huang et al., "Austenite Formation during Intercritical Annealing", Metallurgical and Materials Transactions A, vol. 35, 2004, United States, pp. 3363-3375.
Ismail et al., "Review on sheet metal forming process of aluminum alloys", 17th International Conference on Applied Mechanics and Mechanical Engineering, MS 129, 2016, Egypt, pp. 129-141.
Ivanoff et al., "Retrogression and Reaging Applied to Warm Forming of High-Strength Aluminum Alloy AA7075-T6 Sheet: Physical Metallurical and Materials Science", Metallurgical and Materials Transactions A, vol. 50, 2019, United States, pp. 1545-1561.
Jung et al., "Effects of Pre-Strain on the Aging Behavior of Al 7075 Alloy for Hot-Stamping Capability", Metals, vol. 8(137), 2018, Switzerland, pp. 1-11.
Junjia et al., "A method to evaluate the formability of high-strength steel in hot stamping", Materials and Design, vol. 77, 2015, Netherlands, pp. 95-109.
Kim et al., "Comparison of Drawability between Warm Forming and Cold Forming of Aluminum 6xxx Alloys", IOP Conference Series: Materials Science and Engineering, vol. 418(012029), 2018, Netherlands, 9 pages.
Kumar et al., "Forming Limit Diagram Generation of Aluminum Alloy AA2014 Using Nakazima Test Simulation Tool", Procedia Technology, vol. 24, 2016, Netherlands, pp. 386-393.
Kyungki Industrial Co., "Laser Heating One-step Roller Hemming System", available online at http://www.kyungki.co.kr/research_project/rnd_projects_rediscovered/?lang=en, 2013, 10 pages.
Lotus Engineering Inc., "An Assessment of Mass Reduction Opportunities for a 2017-2020 Model Year Vehicle Program", The International Council on Clean Transportation, Rev 006A, 2010, United States, 308 pages.
Lutsey, "Review of Technical Literature and Trends Related to Automobile Mass-Reduction Technology", available online at https://itspubs.ucdavis.edu/download_pdf.php?id=1390.pdf, 2010, 50 pages.
Mendiguren et al., "Hot stamping of AA7075 aluminum sheets", IOP Conference Series: Materials Science and Engineering, vol. 159 (012026), 2016, Netherlands, 6 pages.
Nasim et al., "Local Thermomechanical Processing for Improving Formability of High Strength Aluminum Sheets", SAE Technical Paper 2022-01-0244, 2002, United States, 5 pages.
National Highway Traffic Safety Administration, "Laboratory Test Procedure for FMVSS No. 214, Dynamic Side Impact Protection", National Highway Traffic Safety Administration, TP-214P-01, 2012, United States, 42 pages.
Osterreicher et al., "Warm-forming of pre-aged Al—Zn—Mg—Cu alloy sheet", Materials and Design, vol. 193 (108837), 2020, Netherlands, 14 pages.
Patel et al., "High speed friction stir welding of AA6063-T6 alloy in lightweight battery trays for EV industry: Influence of tool rotation speeds", Materials Letters, 318, 2022, Netherlands, pp. 1-4.
Patel et al., "High-speed friction stir welding in light weight battery trays for the EV Industry", Science and Technology of Welding and Joining, vol. 27 (4), 2022, United Kingdom, pp. 250-255.
Reaburn, "Ultra-Light Door Design", available online at https://www.energy.gov/sites/prod/files/2017/06/f35/lm120_skszek_2017_o.pdf, 2017, 28 pages.
Schoenberger, "Hot formed aluminum parts", available online at https://web.archive.org/web/20170419062133/https://www.todaysmotorvehicles.com/article/hot-formed-al2016, 8 pages.
Schuster et al., "Characterisation and Comparison of Process Chains for Producing Automotive Structural Parts from 7xxx Aluminum Sheets", Metals, vol. 9(305), 2019, Switzerland, 15 pages.
Skszek et al., "MML: Project Overview", SAE Technical Paper 2015-01-0407, 2015, United States, 9 pages.
Stampingsimulation, "What's the Difference Between a Crash and a Draw Form?", available online at https://stampingsimulation.com/whats-the-difference-between-a-crash-and-a-draw-form/, 2020, 2 pages.
U.S. Department of Energy, "Materials 2017 Annual Progress Report", Vehicle Technologies Office, Office of Energy Efficiency and Renewable Energy, DOE/EE-1711, 2018, United States, pp. 76-97.

* cited by examiner

R/T constant = 0.45
Bending on the roller Path

ALUMINUM SHEET PROCESSING, ALUMINUM COMPONENT PROCESSING, AND ALUMINUM COMPONENTS

CROSS REFERENCE TO RELATED APPLICATION

This application claims priority to and the benefit of U.S. Provisional Patent Application Ser. No. 63/323,428 filed Mar. 24, 2022, entitled "Method for Fabrication of High-Strength Al Components by Stamping at Room-Temperature", the entirety of which is incorporated by reference herein.

STATEMENT AS TO RIGHTS TO DISCLOSURES MADE UNDER FEDERALLY-SPONSORED RESEARCH AND DEVELOPMENT

This invention was made with Government support under Contract DE-AC05-76RL01830 awarded by the U.S. Department of Energy. The Government has certain rights in the invention.

TECHNICAL FIELD

The present disclosure relates to processes for modifying sheet materials as well as components that are formed from sheet material by stamping or deformation processing. In particular embodiments these sheet materials are aluminum (Al) materials and the components are automobile components.

BACKGROUND

The demand for weight savings in automobiles to improve fuel economy and reduce greenhouse emissions has significantly impacted material selection, heat treatments and processing techniques in designing newer generation of lighter frames, beams and automotive components. Despite steel's high density, many automotive safety applications (e.g. side impact beams) still use high strength (e.g. 1500 MPa) boron steels which combines its good formability at elevated temperatures and high fracture toughness after hot form quenching. Although aluminum is a potential light-weight alternative to steels in stamped parts, Al sheet alloys possess limited room-temperature formability and are difficult to stamp into structural components with complicated geometries. High-rate forming as a means to enhance room-temperature formability of Al alloys has been investigated. However, that work focused on 5182-O Al which is a non-precipitation-hardened and relatively low-strength alloy that is not suitable for structural applications.

The present disclosure also addresses the bending, flanging, and joining of materials in specific regions. The industry has been challenged by forming lightweight materials in specific regions, especially at the edges, without cracking or splitting. The present disclosure provides processes and components for lightweight materials that can be bent and formed into other components, with limited drawback from the prior art processes, without cracking or splitting.

SUMMARY

The use of Aluminum (Al) 7xxx series in automobile structural applications is limited by factors such as its low room-temperature formability in peak-aged condition (T6 temper) and the need for off-line artificial aging to regain high strength if it is formed in soft temper. The present disclosure describes two temper conditions that have been established that enable Al 7075 blanks to be room temperature stamped to create side impact beams that achieve near-T6 strength without the need of post-forming artificial aging heat-treatment. It is shown that natural aging at room temperature, after solution treatment and before stamping, provides an alternative to high temperature pre-aging and hot stamping techniques in 7xxx alloys. Both temper conditions of Al 7075 enabled room temperature stamping of the beams without cracking, indicating good formability during stamping. The Al beams were ~38% lighter than the benchmark boron steel beam. The hardness levels in the low-deformation regions of the stamped Al beams were within 88% of a conventional 7075-T6 sheet. Paint-bake (PB) treatment of the stamped beams appeared to cause over aging, lowering the ultimate tensile strength and ductility. Finite element three point bending simulations of the Al beams vs. the boron steel beam showed slightly higher bending force and energy absorption before failure for the 7075 alloy showing good promise for 7xxx series Al as a light-weight alternative to steel beams in this application.

Accordingly, an aluminum sheet stamping process is provided that can include heating an aluminum sheet to a first temperature that is greater than ambient temperature; quenching the aluminum sheet to cool the aluminum sheet to a second temperature that is less than the first temperature; after the quenching allowing the aluminum sheet to rest at ambient temperature for at least 24 hours; and stamping the aluminum sheet to form a stamped component.

Stamped aluminum components comprising one or more portions having an HRB hardness of greater than 87 are also provided.

Processes are also provided for fabricating an aluminum component from an aluminum sheet. The processes can include modifying formability of at least one discrete portion of an aluminum sheet and compressing and/or expanding at least a portion of the one discrete portion to form a fabricated component. The fabricated component can include at least one aluminum member comprising a compressed and/or expanded modified discrete portion.

DRAWINGS

The patent or application file contains at least one drawing executed in color. Copies of this patent or patent application publication with color drawing(s) will be provided by the Office upon request and payment of the necessary fee.

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
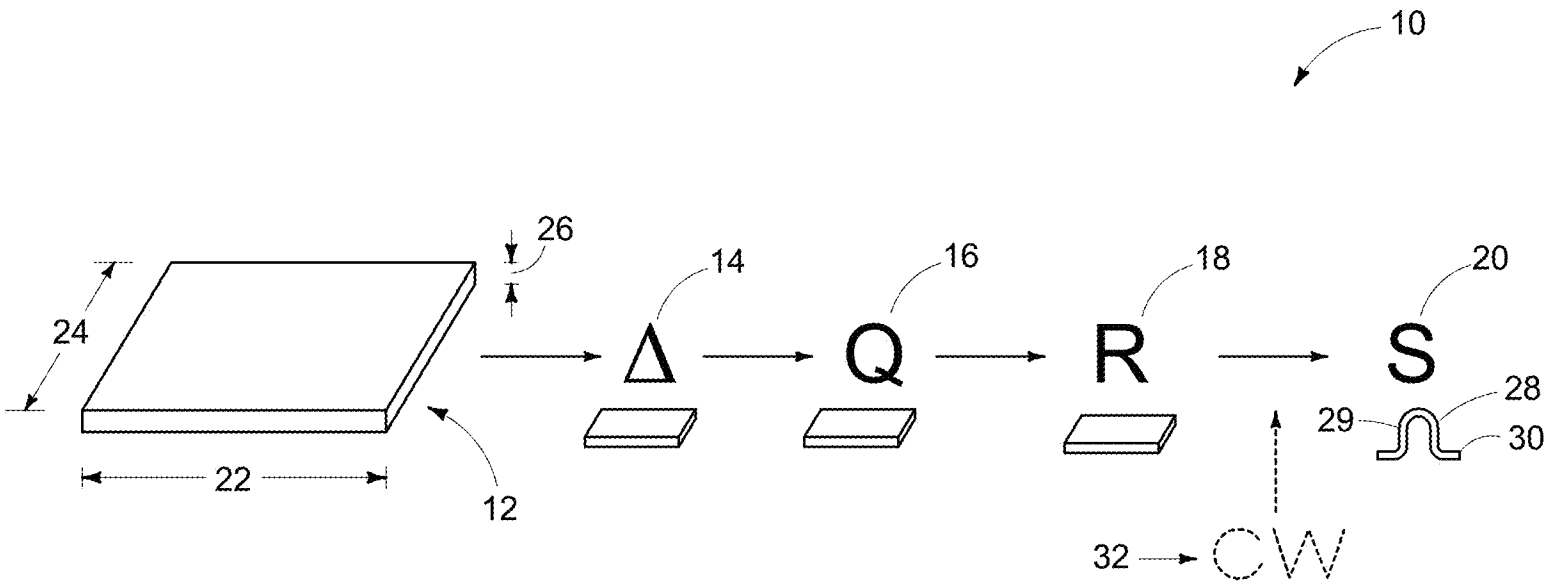
FIG. 1 is an example process according to an embodiment of the disclosure.
Figure 3:
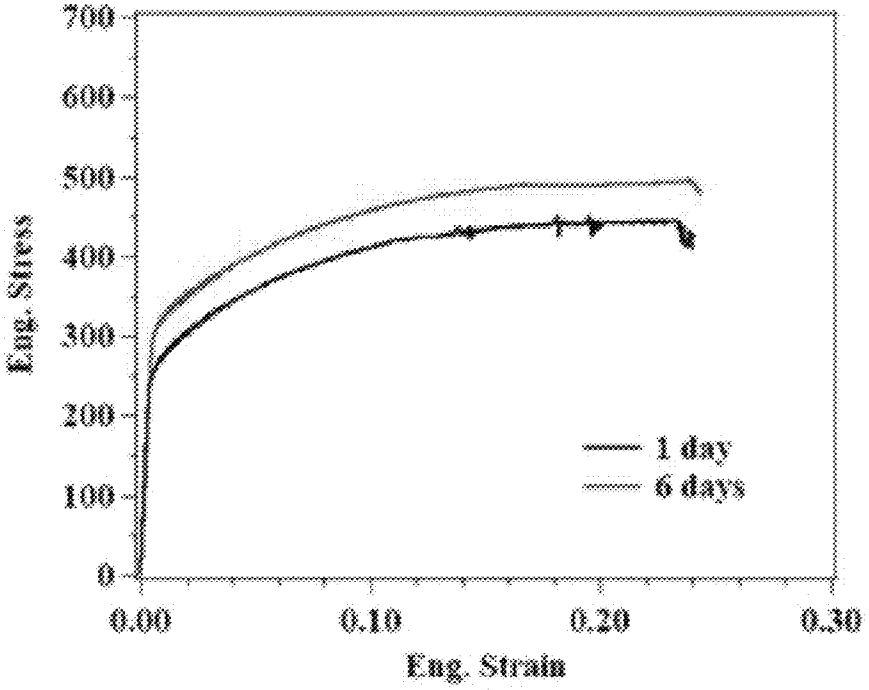
FIG. 3 is data collected from materials at stages in the process according to example implementations.

The present disclosure will be described with reference to FIGS. 1-38. Referring first to FIG. 1, an example aluminum sheet stamping process 10 is depicted. Process 10 can include heating an aluminum sheet 12 at 14, quenching the sheet at 16, resting the sheet at a temperature less than which it was heated at 18, and then stamping the sheet at 20. In accordance with example implementations, after quenching and before stamping, cold work can be performed on the sheet.

In accordance with example implementations, sheet 10 can be heated to a first temperature that is greater than ambient temperature. The sheet can then be quenched to cool the aluminum sheet to a second temperature that is less than the first temperature. After quenching, the aluminum sheet is allowed to rest at ambient temperature for at least 24 hrs. After the at least 24 hrs of resting, the aluminum sheet can be stamped to form a stamped component. Upon stamping, discrete portions of the processed sheets will be compressed and/or expanded, for example, discrete portions will be subjected to bending and/or stretching.

In accordance with example embodiments, the temperature to which the sheet is heated can be at least 450° C. or less than 540° C. In accordance with example implementations, the temperature to which the sheet is heated can be from 450° C. to 540° C. or from 480° C. and 490° C. The sheet can be maintained at these temperatures or with these temperature ranges for a duration to dissolve the precipitates that may exist in the material. In this example using 2.5 mm sheet, 40 minutes were used, but the duration can be increased if the sheet is thicker and vice-versa.

The material of the sheet and/or the dimensions of the sheet may support the use of other temperatures and/or times maintained at those temperatures. For example, the aluminum sheet can comprise an aluminum alloy, such as 6xxx, 7xxx series aluminum sheets, and more particularly 7075 series aluminum sheets. Accordingly, the sheets can have thickness 26 between opposing upper and lower surfaces, as well as a length 22 and depth 24 between opposing edges. The sheet can have a thickness of at least 0.7 mm or between 0.7 and 4 mm.

In accordance with the process parameters, the sheet can be quenched from the first temperature to a second temperature to cool the sheet relatively rapidly. For example, cooled temperature or second temperature can be less than 30° C. or as low as 18° C. or between 18° C. and 30° C. The quenching can be performed with a fluid such as an oil and/or water. The oil can be mineral oil.

As indicated above and shown in FIG. 1, process 10 can include, after the aluminum sheet has rested for at least 24 hrs and before stamping the aluminum sheet, modifying at least portion of the aluminum sheet. This stage is shown as CW 32, which is considered cold work. For example, the rested sheet can be worked but under ambient conditions to modify the sheet. This modification can be formability for example, such as reducing hardness, changing strength or stiffness in discrete portions. Bending and/or unbending under ambient conditions is an example of such work.

According to a particular example, AA7075 Al sheets with a thickness of 2.5 mm and T6 temper were solution heat treated at 480° C. for 40 mins and then quenched in a water bath at room-temperature. They were then subjected to natural aging at ambient laboratory temperature (~22° C.) and the hardness was measured as a function of natural aging duration. The as-received Al 7075-T6 blanks (for stamping) were solutionized as above and subjected to natural aging treatments for 1 day and 6 days, resulting in two tempers which are referenced as Temper 1 and Temper 2, respectively. Stamping dies for the Al alloys were fabricated and prototype side impact beams were stamped at room temperature from the as-received Al 7075-T6 blanks and naturally aged Al 7075 blanks. Some stamped beams were subjected to simulated Paint Bake (PB) treatment (180° C. for 20 mins.) 2 months after stamping. Prototype beam design was based on an in-production hot-stamped steel side impact beam design for location at the bottom side of the front car door frame arranged diagonally across the door.

Per ASTM E8, tensile test samples were extracted from the stamped Al beams. The non-PB beam samples were tensile tested 8 months after stamping and the PB beam samples were tensile tested 8 months after PB. Samples were tested with an MTS servo hydraulic frame with Instron 8800 controller using constant crosshead speed and at an initial engineering strain rate of $5\times10^{-3}$ $s^{-1}$. The strain was measured with an optical extensometer following the marks at the ends of the gage region.

Al 7075 stamped beams from both tempers were cut into nine sections for hardness measurements with lengths varying between 10-15 cm. The non-PB beam samples were hardness tested 4 months after stamping and the PB beam samples were hardness tested 8 months after PB. These sections (portions) were further cut into smaller sections according to visual features observed in the stamped beam. These were qualitatively separated into three categories as: Flat overhanging pieces which represented regions with No Plastic Deformation (NPD, e.g., 30 in FIG. 1), relatively flat side outer walls which represented regions with Low Plastic Deformation (LPD, e.g., 29 in FIG. 1) and bent corners and edges which represented regions with High Plastic Deformation (HPD, e.g., 28 in FIG. 1). One or more of these discrete portions (28, 29, and/or 30) of the stamped aluminum component can have an HRB greater than 87.

Hardness was measured using Rockwell B scale with a 1.58 mm (1/16th inch) diameter ball indenter under a 100 kgf load. About 4 to 8 indents were taken at each measurement location. In the case of the HPD regions, the hardness was measured on the concave side. The radii of HPD regions were measured to be in the range of 7-11 mm and therefore, the measured hardness values were corrected by subtracting 1.5 HRB per the guidance in ASTM E18 standard. Overall, about 250 hardness measurements were made on each stamped beam and compared against the hardness of the as-received T6 temper sheets. Thickness measurements were conducted from these areas of interest as well. Engineering thickness strains were calculated by measuring thickness of the LPD and HPD regions with a micrometer screw gauge, while the initial thickness was measured from the NPD regions.

Mechanical properties for both Al 7075 and boron steel materials are provided in Table 1. Yield stress and fracture strain for boron steel are referenced. For Al 7075 Temper #2, the Young's modulus and fracture strain were derived from tensile experiments conducted in this study and Poisson's ratio and density are referenced for a naturally aged 7075 sheet similar to that used in this study.

TABLE 1

Elastic, density and fracture material properties for Temper #2 Al 7075 and boron steel.

| Material | Young's modulus (GPa) | Poisson's ratio | Density ($kg/m^3$) | Fracture strain |
|---|---|---|---|---|
| Temper #2 Al 7075 | 70 | 0.334 | 2800 | 0.15 |
| Boron Steel | 210 | 0.29 | 8050 | 0.075 |

Figure 2:
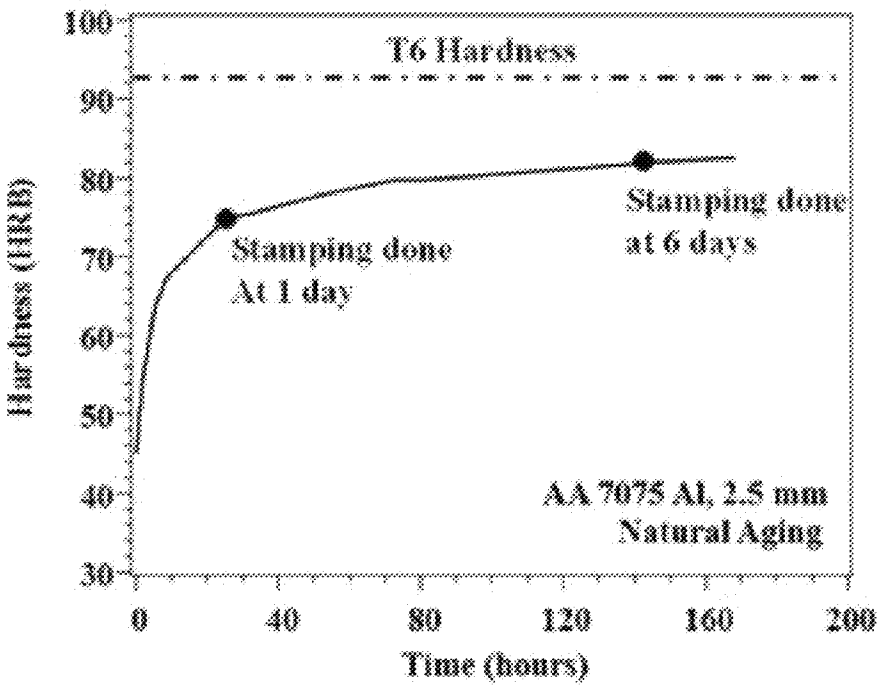
FIG. 2 is data collected from materials at stages in the process according to example implementations.

FIG. 2 depicts the natural aging curve for the Al 7075 following solutionization (heating) and quenching. The data shows that the material is very soft just after solutionization (heating), with a hardness of ~44 HRB. However, its hardness increases rapidly within the first 24 hours to ~75 HRB. Upon further natural aging, the hardness continues to increase, although at a somewhat lower rate, reaching a hardness of ~83 HRB after 168 hours (1 week). The hardness of the as-received Al 7075 sheet in T6 temper was ~93 HRB. Thus, even after a week of natural aging, this alloy did not reach its peak hardening potential and is expected to continue to naturally age with time. Tensile testing, shown in FIG. 3, was also done at 1 day and 6 days which showed stress fluctuations during deformation confirming Portevin-Le Chatelier (PLC) effect at 1 day which diminishes by 6 days of natural aging.

Figure 4:
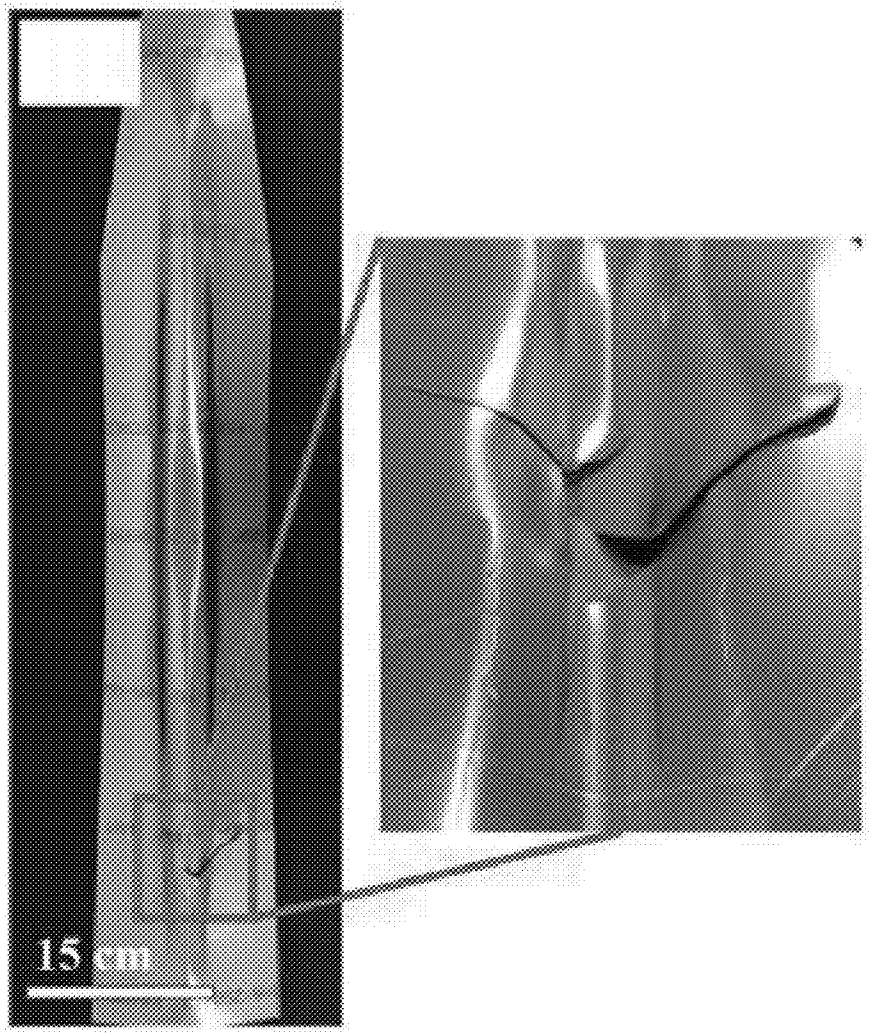
FIG. 4 is a depiction of a stamped part prepared according to prior art methods.

In accordance with example implementations the aluminum sheet can be stamped at ambient or room temperature. Al 7075-T6 blanks were stamped to die strokes of 25%, 50%, and 75% to test its ability to be stamped in peak-aged condition. The blanks formed into the rough outline of the beam at 25% stroke without any cracking. However, there was significant cracking at 50% and 75% stroke at the HPD regions of the beam. FIG. 4 shows the Al 7075-T6 stamping experiment at 75% stroke with severe cracking at the HPD region at the lower part of the beam. The inability of Al 7075-T6 to form at room temperature without cracking shows the very limited formability of Al 7075 in its peak strength (T6) temper at room temperature.

Figure 5:
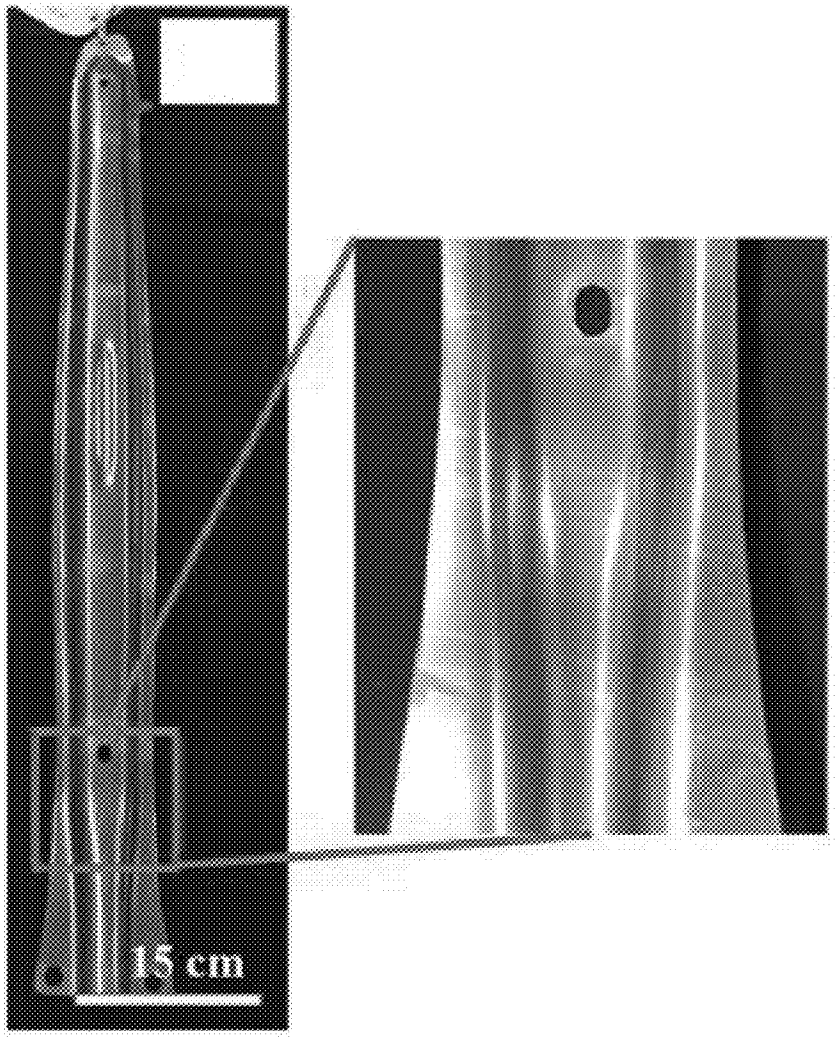
FIG. 5 is a depiction of a stamped part produced according to an embodiment of the disclosure.

Contrary to the results in FIG. 4, both Al 7075 tempers #1 and #2, were successfully stamped into the final beam shape at room-temperature. FIG. 5 shows the stamped impact beam for at least one component of the Al temper conditions used according to this process, which showed successful stamping at room temperature with no failure even around the HPD regions. The surface finish of the beams from either of the new tempers was acceptable. While the stamped beams did show some scratch type marks along the HPD regions caused by the friction against the metal die during stamping, no visible cracks were found. The Al beams had an average weight of 897 g compared to 1449 g for the benchmark hot stamped boron steel beam corresponding to a weight savings of ~38% offered by the Al beams. The fully formed beams, without any cracks, show Al 7075 can be formed into complex structural components at room temperature by appropriately controlling the initial temper of the blanks and the stamping process.

Figure 6:
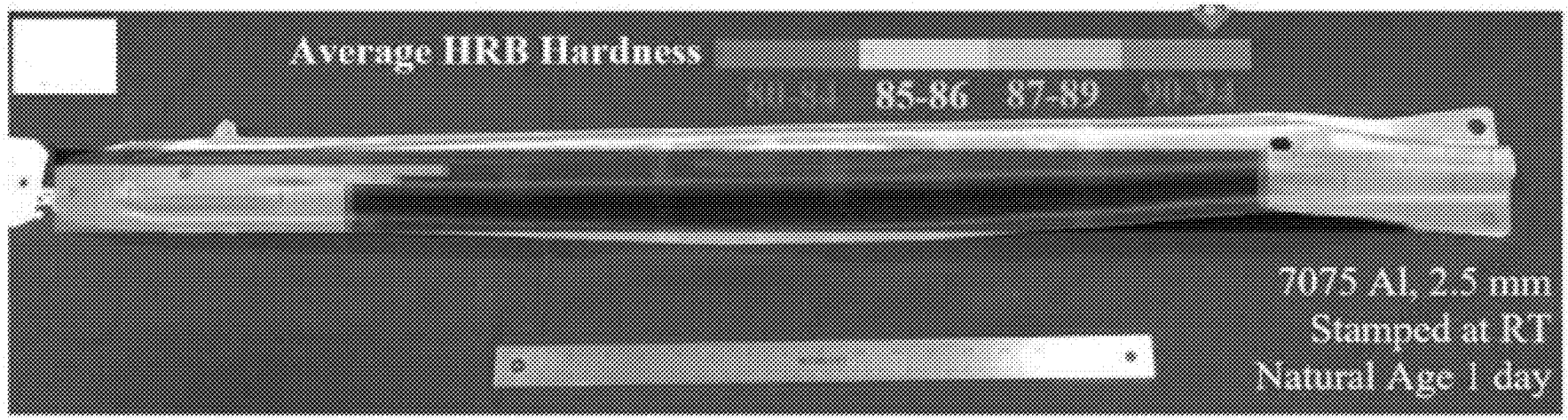
FIG. 6 is a depiction of a stamped component according to an embodiment of the disclosure.
Figure 7:
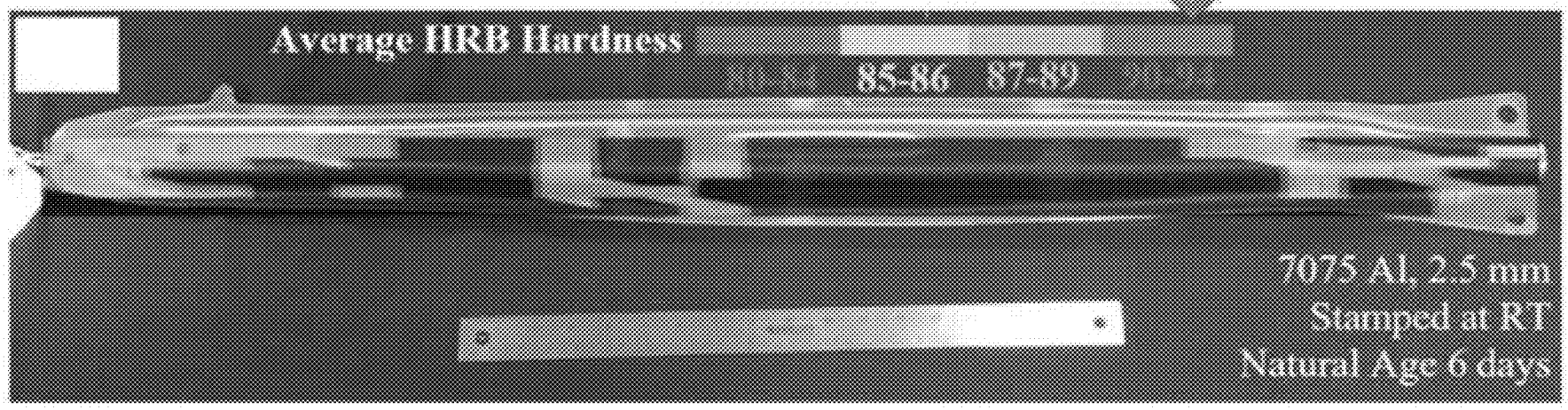
FIG. 7 is a depiction of a stamped component according to an embodiment of the disclosure.

Color FIGS. 6-7 show the room temperature stamped Al 7075 beams (for both sheet tempers) and the corresponding Rockwell B hardness contours. For the Temper #1 beam, a total of 253 hardness measurements were taken and for Temper #2 beam, 238 measurements were taken over all deformed regions of the beam. Dark orange color depicts the Al 7075-T6 hardness value range, from 90 to 94 HRB, while green is the lowest hardness range, from 80 to 84 HRB. The hardness measurements from specified regions of the beam have been summarized in Table 2 for both sheet tempers respectively. Hardness results show that >80% of the measured values are within 90% of the T6 hardness. In each beam the overall hardness values range from 81-92 HRB for both tempers. The HPD regions have the highest hardness ranging between 87-92 HRB, showing the ability to achieve near-T6 hardness using a combination of initial natural aging and deformation in stamping. LPD regions have hardness between 82-89 HRB and NPD regions have hardness between 81-84 HRB. Hardness measurements appear to be consistent for each beam as hardness values at any given location are within ±1 HRB. For any given location on the beam, the similarity of hardness values in the beams also indicates that the room-temperature stamping process produced repeatable mechanical properties that appear to be independent of the initial temper of the blanks. These results show the success of the room temperature stamping to produce near-T6 hardness in stamped beams by controlling the initial sheet temper and the amount of deformation in stamping process and without the need of a post-stamping artificial aging treatment.

TABLE 2

Hardness results summary for Al 7075 stamped beams for Temper #1 and Temper #2.

| | Hardness HRB ± Std Dev | # of Measurements (% of Total measurements) | % of T6 Hardness (93 HRB) |
|---|---|---|---|
| Beam Temper #1 | | | |
| Entire beam | 86.3 ± 2.6 | 253 (100%) | 93% |
| HPD and LPD Regions | 87.0 ± 2.2 | 211 (83%) | 94% |
| NPD Regions | 82.8 ± 1.7 | 42 (17%) | 89% |
| Maximum | 90.9 ± 1.9 | | 98% |
| Beam Temper #2 | | | |
| Entire beam | 85.6 ± 2.7 | 238 (100%) | 92% |
| HPD and LPD Regions | 86.1 ± 2.6 | 204 (86%) | 93% |
| NPD Regions | 82.6 ± 1.4 | 34 (14%) | 88% |
| Maximum | 91.7 ± 0.8 | | 99% |

Figure 8:
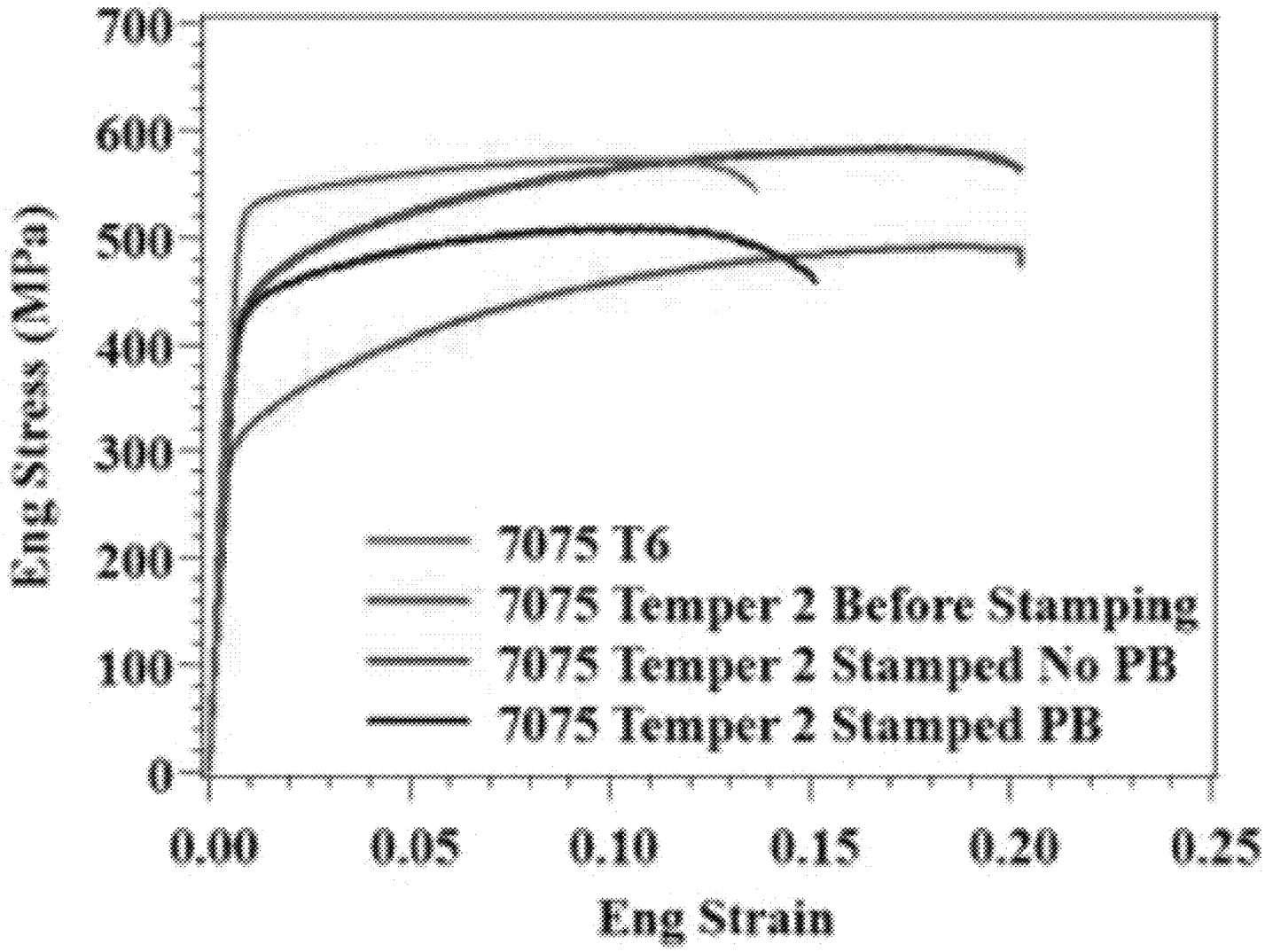
FIG. 8 is data collected for components produced according to an embodiment of the disclosure.
Figure 9:
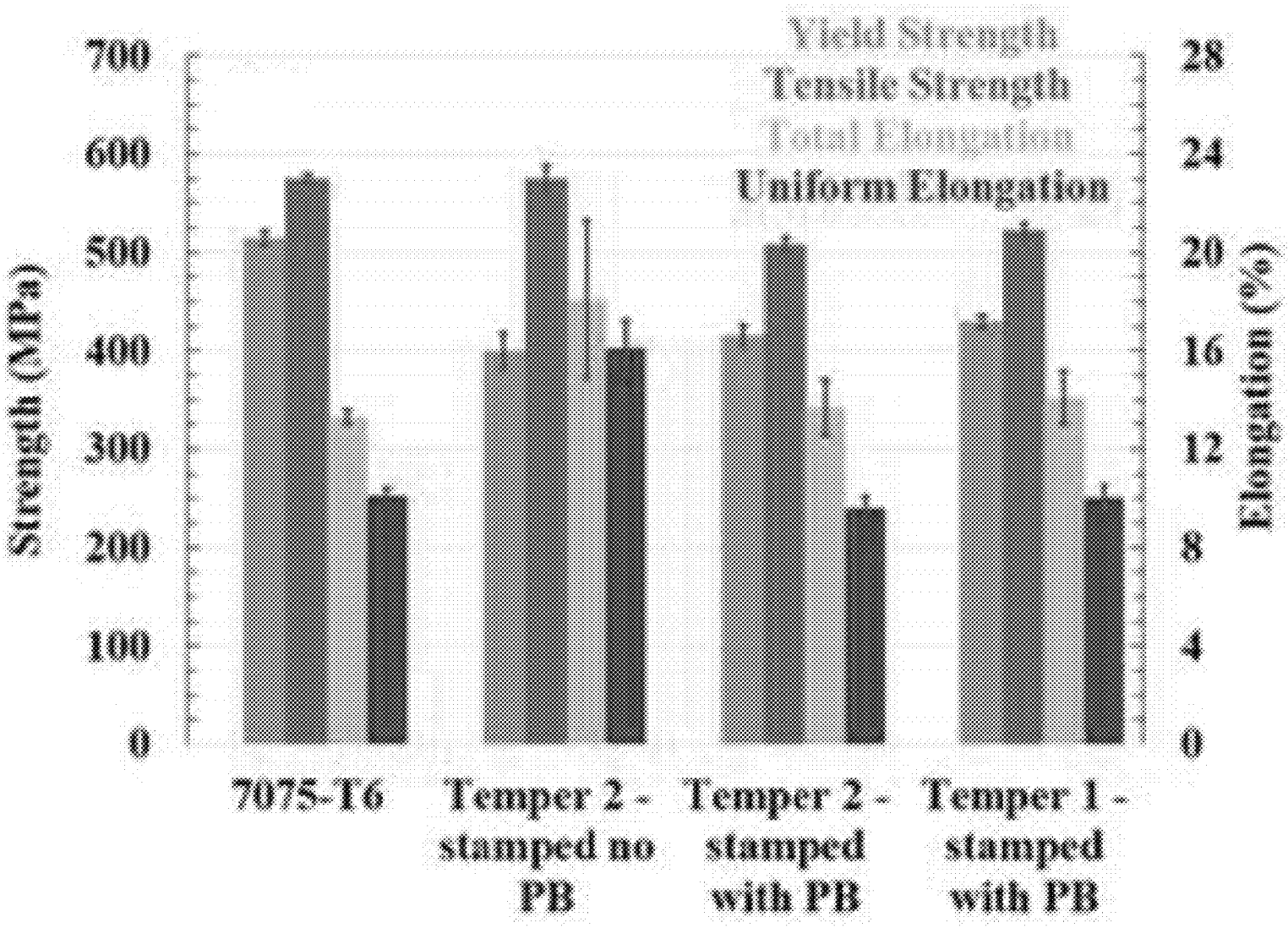
FIG. 9 is data collected for components produced according to an embodiment of the disclosure.

FIG. 8 shows the room-temperature tensile stress-strain curves of the Al 7075 blanks for the as-received T6 condition and Temper #2. FIG. 8 also includes the effect of stamping and subsequent PB treatment on the tensile curves produced from the Temper #2 beam. The as-received Al 7075 T6 blanks show a yield stress of 515 MPa which decreases to 310 MPa after Temper #2 treatment. After room temperature stamping, the yield stress of 7075 Temper #2 increases to 400 MPa and shows considerable strain hardening without the loss of ductility with elongation to failure remaining similar as in unstamped state at ~18%. PB treatment of the Temper #2 stamped beam lowered its ductility to ~14% but yield stress remained unaffected at 415 MPa and was similar to the non-PB beam. However, a larger decrease was found in ultimate tensile strength (UTS) after PB from 576 MPa to 507 MPa for Temper #2. Referring to FIG. 9, similar mechanical property trends are observed for PB Temper #1. Essentially, the PB step reduced the UTS and uniform elongation of the stamped beams although the yield strength slightly increased.

Figure 10:
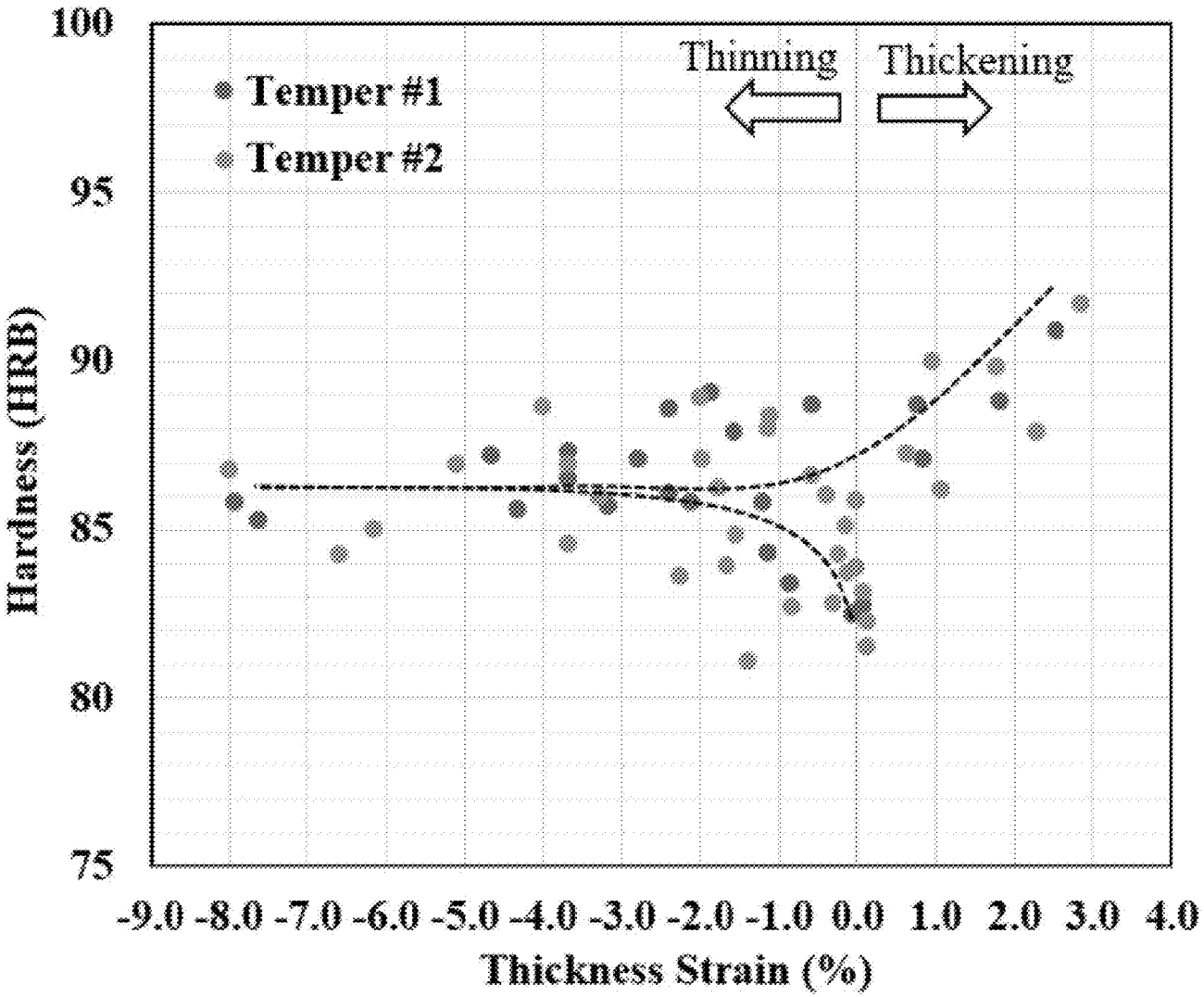
FIG. 10 is data collected for components produced according to an embodiment of the disclosure.

FIG. 10 demonstrates a clear increase in hardness with strain in the regions that thicken (positive strain values on the x-axis) during stamping and the highest hardness values were observed in these regions at 87-93 HRB. The lowest values of hardness correspond to the undeformed regions of the beam as expected, with hardness increasing for thinning regions (negative strain values on the x-axis). The hardness data also show a larger scatter at low thinning strains, −1.0% to −2.0%, but eventually becomes almost independent of strain and reaches a steady value of ~87 HRB at the thinning strains—4.0%, as indicated by the trendlines in FIG. 10.

Figure 11:
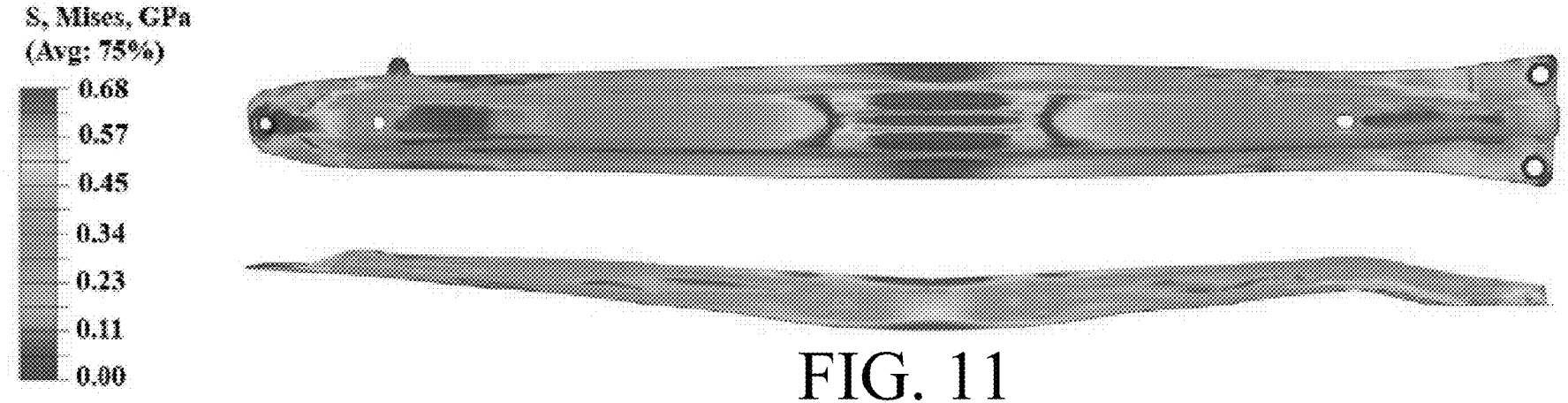
FIG. 11 is data collected for components produced according to an embodiment of the disclosure.
Figure 12:
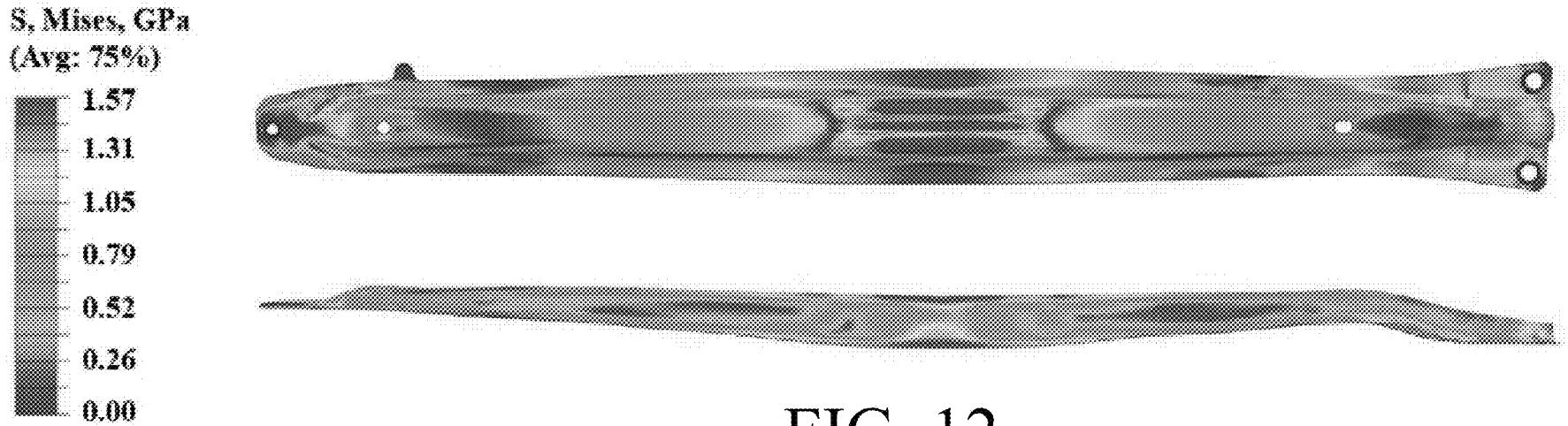
FIG. 12 is data collected for components produced according to an embodiment of the disclosure.

FIGS. 11-12 show the von Mises stress contours on the bottom surface of the beam for Al 7075 Temper #2, no PB, (FIG. 11) and boron steel (FIG. 12) just before damage initiation. The areas shown in red color represent the high-stress areas where damage is likely to occur. In both the beams, the damage was observed to start at the center of the beam and later independently initiated near the bolted regions. To ensure validity of the bending simulations, the first damage site was made sure to have occurred at the central part of the beam and not at the bolts by adjusting the fixed distributive load at the bolts. The steel beam showed a von Mises stress of 1.572 GPa just before failure and a maximum deflection (before failure) of 15.88 mm at the central region. The Al 7075 Temper #2 stamped beam showed a von Mises stress of 0.678 GPa just before failure and a maximum deflection (before failure) of 32.88 mm. As deformation was further increased for both beams, cracks started to form at the single bolt location on the left side of the beam, and later near both bolt locations on the right side of the beam.

Figure 13:
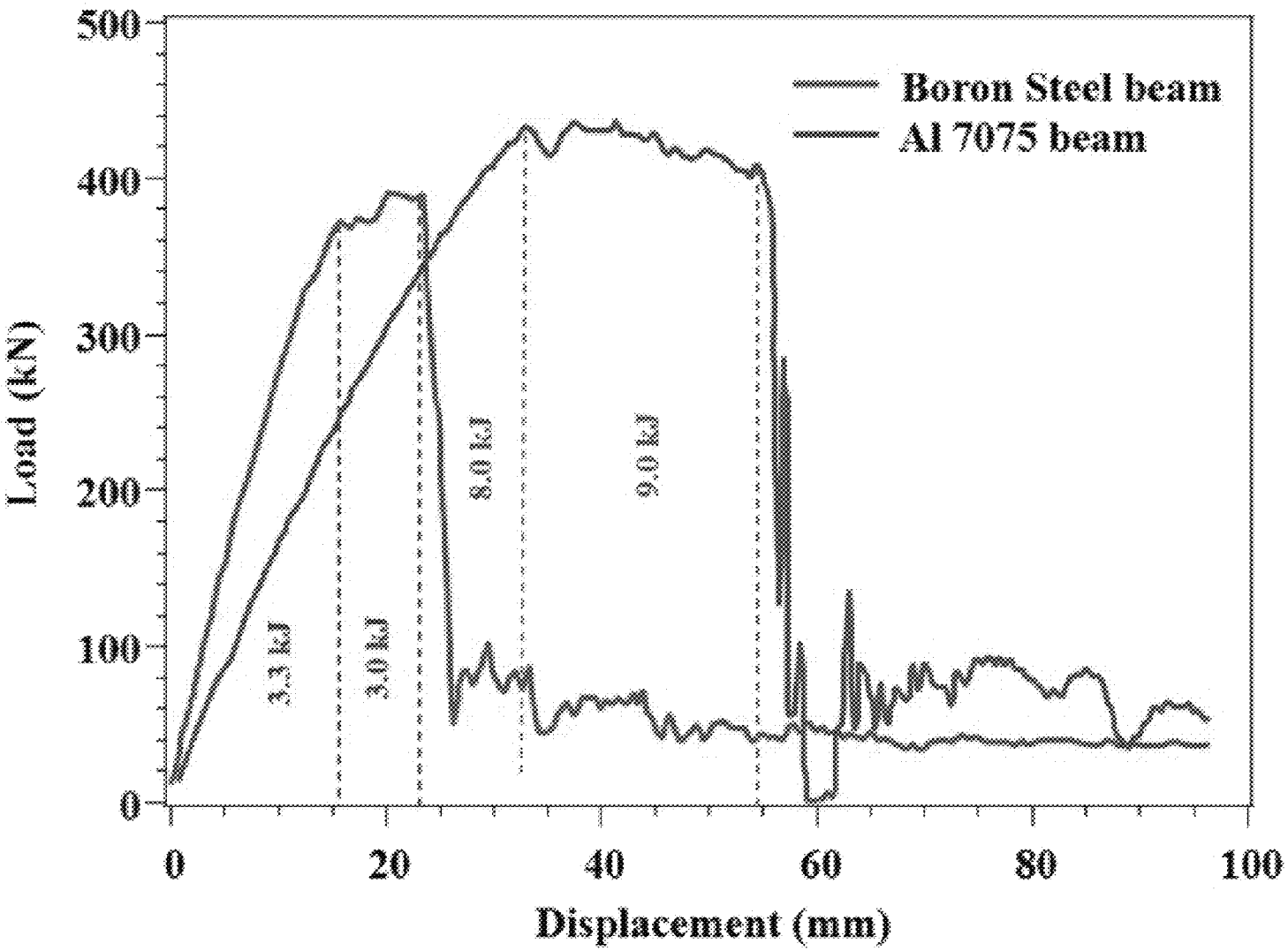
FIG. 13 is data collected from components produced according to an embodiment of the disclosure as well as an example boron steel beam.
Figure 14:
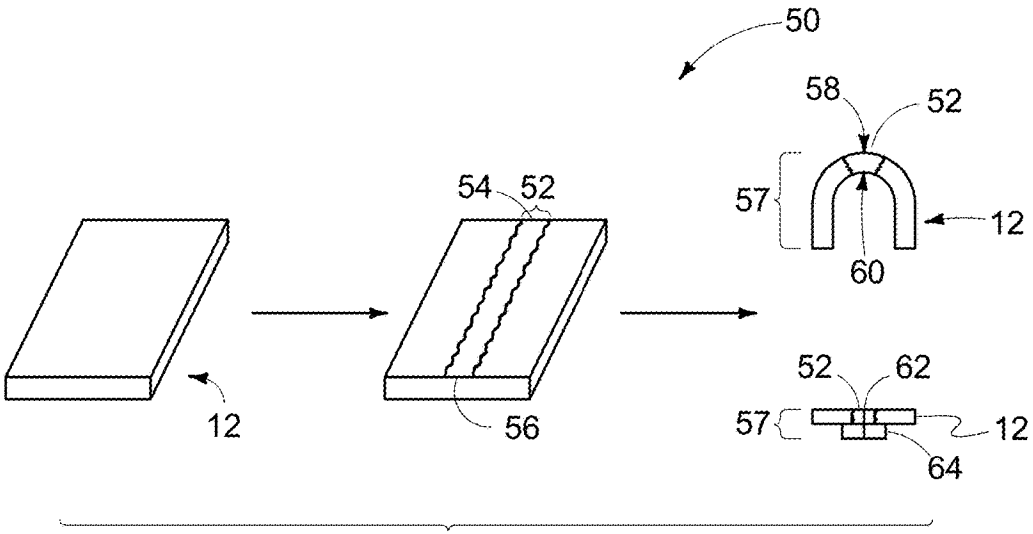
FIG. 14 is a process for fabricating components according to an embodiment of the disclosure.

FIG. 13 shows a comparison of the load vs. displacement curves for Al 7075 Temper #2 beam and boron steel beam under bending. FIG. 13 shows that the initial response of the beams varies due to the large difference between Young's modulus of the two materials. The steel beam reaches a maximum load of 392 kN in ~20 mm displacement while the Al beam reaches a maximum load of 436 kN in ~35 mm displacement. Subsequent to the maximum load, further displacement results in a decrease in load that is associated with significant damage accumulation in the beams. The energy absorbed by each beam at different stages during loading is also indicated in FIG. 13: The energy absorbed during the linear loading portion by the steel beam was 3.3 kJ which is significantly lower than 8 kJ energy absorbed by the Al 7075 Temper #2 beam. Furthermore, the Al 7075 beam showed an even higher energy absorption in the damage accumulation region, 9 kJ, albeit with more deflection due to Al beam's higher ductility, as compared to 3 kJ for steel. These results show that both beams can tolerate similar loads with the Al 7075 beam absorbing ~2.7× greater energy before cracking but also bowing more than the boron steel beam.

As described above, the 7075 blanks were given a natural aging treatment for a W temper of 1 day and 6 days followed by room-temperature stamping and as shown in FIGS. 4-7, these blanks were successfully stamped into the selected prototypical component (side impact beam). In addition to enabling stamping at room temperature, a W-temper between 1-6 days is also expected to provide scheduling flexibility to a manufacturer, i.e., a strict production schedule to stamp a W-temper blank at a specific time is not necessary. Instead, the approach used here can relax the production schedule such that the blanks can be stamped anywhere between 1-6 days of natural aging. The stamped beams achieved near-T6 hardness/strength, confirming the hypothesis of this work that natural aging between 1-6 days, supplemented by work hardening and precipitation hardening, can produce near-T6 strength in stamped beams. It was also observed that PB treatment lowers the UTS of room temperature stamped beams, possibly due to over aging, and therefore one can optimize this approach and avoid reduction in UTS.

The UTS of the Temper #2 stamped beam is similar (~575 MPa) to that of the 7075-T6. Achieving near T6-level UTS in the stamped condition, without the need for any artificial aging, simultaneously achieving formability at room-temperature and high strength. Retrogression forming by heating the AA7075 blank to 200° C. before stamping may result in a successful draw depth of 45 mm and failure at 60 mm draw depth. The maximum draw depth of this side impact beam for Temper #1 and Temper #2 was 50 mm which was within the successful draw depth range. Furthermore, since the Al beams are ~38% lighter than the boron steel beam, this work has the potential for significantly lightweighting structural components without the need of high-temperature stamping dies or off-line artificial aging heat-treatments.

In accordance with the example processes, natural aging between 1-6 days, supplemented by work hardening and precipitation hardening, can produce near-T6 strength in stamped beams. PB treatment lowers the UTS of such stamped beams and therefore one can optimize this approach.

Accordingly, successful stamping of Al 7xxx series, in particular 7075, at room temperature by controlling the initial temper of the sheet. Two tempers were developed that showed excellent room temperature formability with successful stamping of prototype side impact beams with no fracture or cracking. In comparison, an Al 7075-T6 sheet could not be formed in the same geometry and instead fractured during room temperature stamping at only 50% stroke. The stamped beams, formed out of 2.5 mm Al sheet, showed comparable strength to the Al 7075-T6 temper and were 38% lighter than boron steel beam (1.5 mm thick) of similar design. In FEM simulations, the as-stamped Al beams showed a higher bending force as compared to the steel beam. The ultimate tensile strength of the as-stamped Al beams matched that of Al 7075-T6 (576 MPa) and demonstrated higher uniform (17 vs. 8%) and total elongation (18 vs. 13%) although at a lower yield strength (400 vs 515 MPa). PB of the stamped Al beams resulted in a decrease in ultimate tensile strength (508 MPa) and elongation (14%), but the yield strength slightly increased to 415 MPa. The as-stamped Al beams showed a higher bending force as compared to the steel beam in FEM simulations, albeit with more deflection due to their significant ductility. The hardness of stamped Al beams from both tempers also matched the hardness of the Al 7075-T6 condition with the lowest hardness at 82 HRB, which is 88% of the T6 hardness. The sheet tempers, thus, developed in this work enable room temperature stamping of Al 7xxx series without the need of hot-stamping dies or a separate post-stamping heat treatment to achieve near-T6 strength. The stamped Al 7xxx alloy has good formability, high strength and bending strength and could be used as a potential alternative to boron steels in the side impact beam application.

Referring to FIGS. 1, 6-7, and 11-12, stamped aluminum components are provided that can include one or more portions having an HRB hardness of greater than 87. These stamped aluminum components can be aluminum alloys such as 6xxx and 7xxx alloys. These one or more portions of the stamped component can be formed post quenching through stamping. Particularly, during the stamping the portions having HRB's greater than 87 can be formed when the sheet is compressed or expanded during stamping.

Referring next to FIGS. 14-37 example processes 50 for fabricating an aluminum component 57 from an aluminum sheet 12 are provided. Processes can include modifying formability of at least one discrete portion 52 of aluminum sheet 12 and compressing 60 and/or expanding 58 at least a portion of discrete portion 52 to form a fabricated component 57. This compressing and/or expanding can occur at discrete portions of the processed sheets when subjected to either bending, stretching, riveting, deep drawing, shearing, or expansion.

Figure 15:
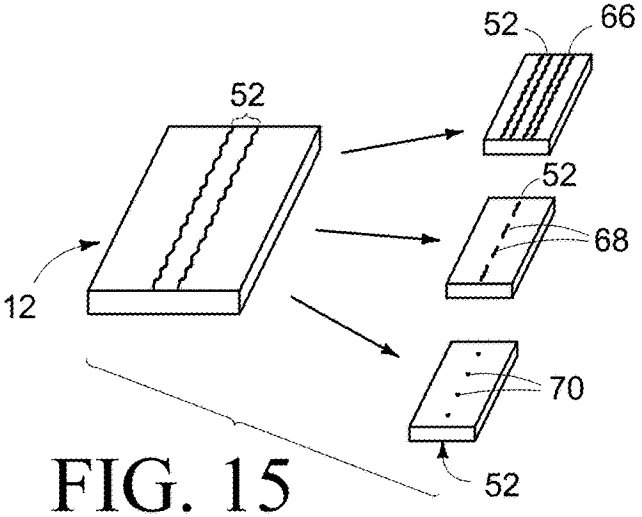
FIG. 15 depicts additional implementations of the process of FIG. 14 according to an embodiment of the disclosure.

Discrete portion 52 can be linear extending at least partially between opposing edges 54 and 56 of aluminum sheet 12, for example. In accordance with FIG. 15, discrete portion 52 can include a plurality of modified portions (52 and 66, 68, and/or 70) arranged along the linear extension. Accordingly, as shown in FIG. 15, at least another discrete portion 66 of aluminum sheet 12 can be modified. As shown, one discrete portion 52 and another discrete portion 66 can be laterally adjacent to one another. Both of the modified discrete portions can be arranged linearly extending at least partially between opposing edges 52 and 56 of aluminum sheet 12.

In accordance with example implementations, the modifying can include roller bending and unbending the discrete portion of the aluminum sheet. This roller bending and unbending can be facilitated by heating the aluminum sheet. The roller bending and unbending can be performed continuously along discrete portion 52 or intermittently along discrete portion 52 as shown in FIG. 15 as stitches 68.

The modifying can also include friction stir processing at discrete region 52. The friction stir processing can be performed continuously along one discrete portion 52 of aluminum sheet 12, as shown in FIG. 15, intermittently along discrete portion 52, as shown in FIG. 15 as stitches 68, and/or as plunges 70.

Accordingly, fabricated components of the present disclosure can include at least one aluminum member 12 comprising a compressed 60 and/or expanded 58 modified discrete portion 52. The modified discrete portion 52 can include a stretch, draw, and/or a bend such as that shown in FIG. 14 of one aluminum member.

In other configurations, the modified discrete portion is about a rivet 62 coupling aluminum member 12 to another member 64. The other member can be the same or different material from the aluminum member.

Figure 16:
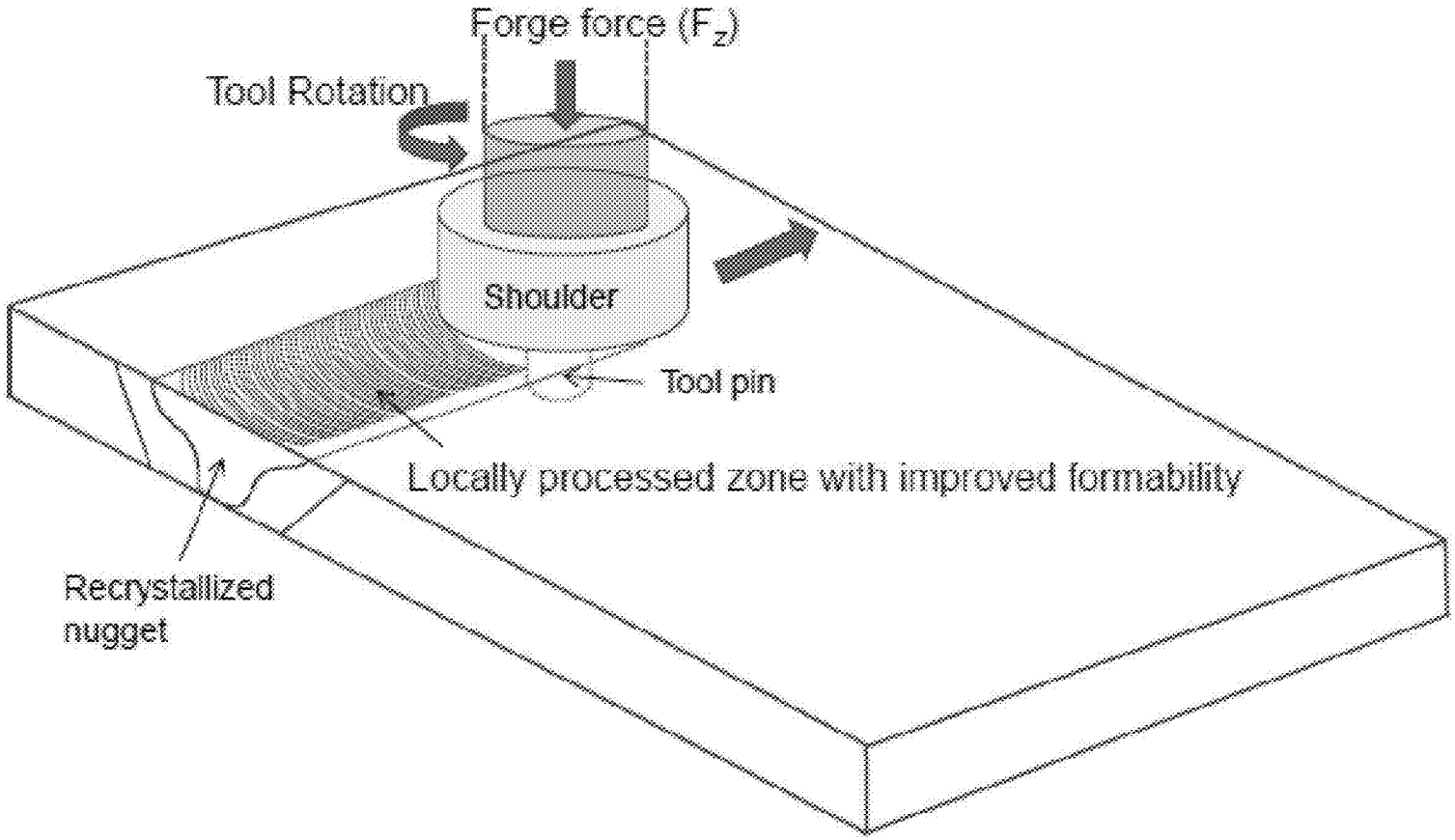
FIG. 16 is an example of one implementation for modifying formability of a discrete portion of an aluminum sheet according to an embodiment of the disclosure.

Referring next to FIG. 16, an example implementation of friction stir processing is shown wherein a sheet is processed using friction stir processing with a rotating die tool head and a tool pin. In accordance with example implementations, the processing can include simply using a configuration that has a tool having a shoulder and a tool pin. It can also include utilizing a pinless tool head having just the rotating shoulder. It can also include utilizing just the pin of the tool with a non-rotating shoulder. A non rotating shoulder will result in smoother crown surface (as compared to rotating shoulder) after processing. In accordance with example implementations, force is applied into the material both in a downward direction and also while spinning the tool and traversing the tool across the face of the sheet. This traversal creates the discrete portion 52. These discrete portions can be straight or curved.

Figure 17:
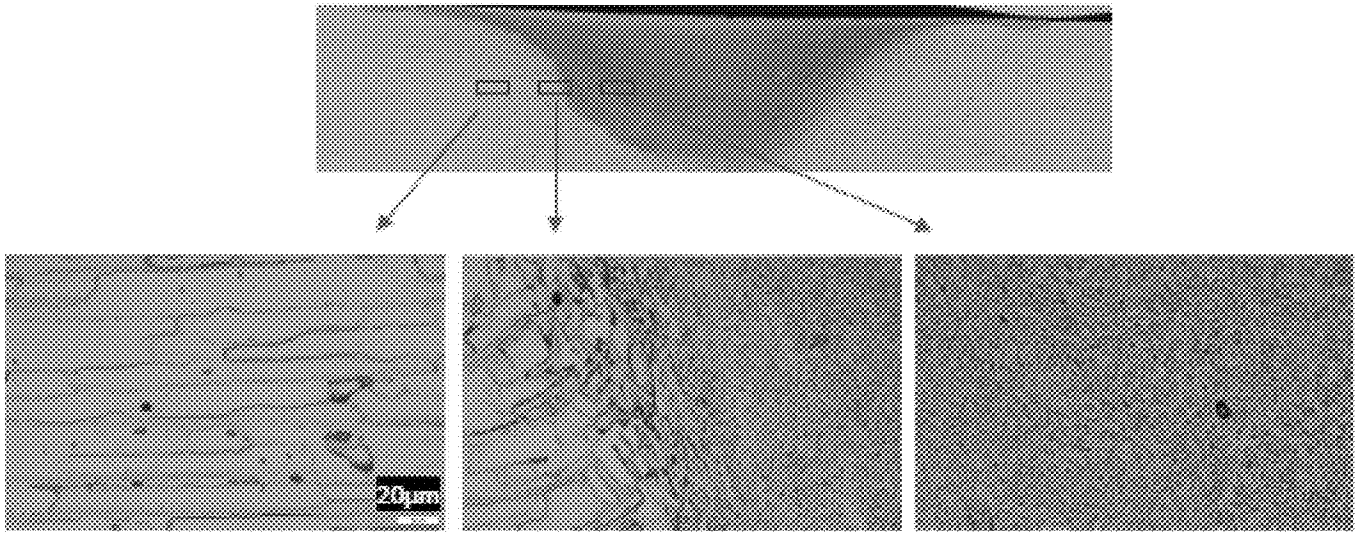
FIG. 17 is a cross sectional view of modified portions of an aluminum sheet using friction stir processing according to an embodiment of the disclosure.
Figure 18:
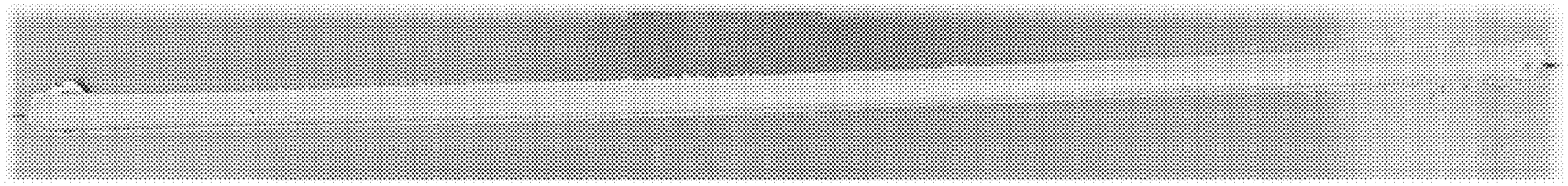
FIG. 18 is a depiction of a top view of a modified sheet having a modified formability region according to an embodiment of the disclosure.

Referring next to FIGS. 17 and 18, cross sectionals of modified portions are shown in FIG. 17 demonstrating the modified portion of an aluminum sheet, and in FIG. 18 a top view of the modified portion within an aluminum sheet depicts the linear extension of the friction stir processed region between opposing edges of an aluminum sheet.

Figure 20:
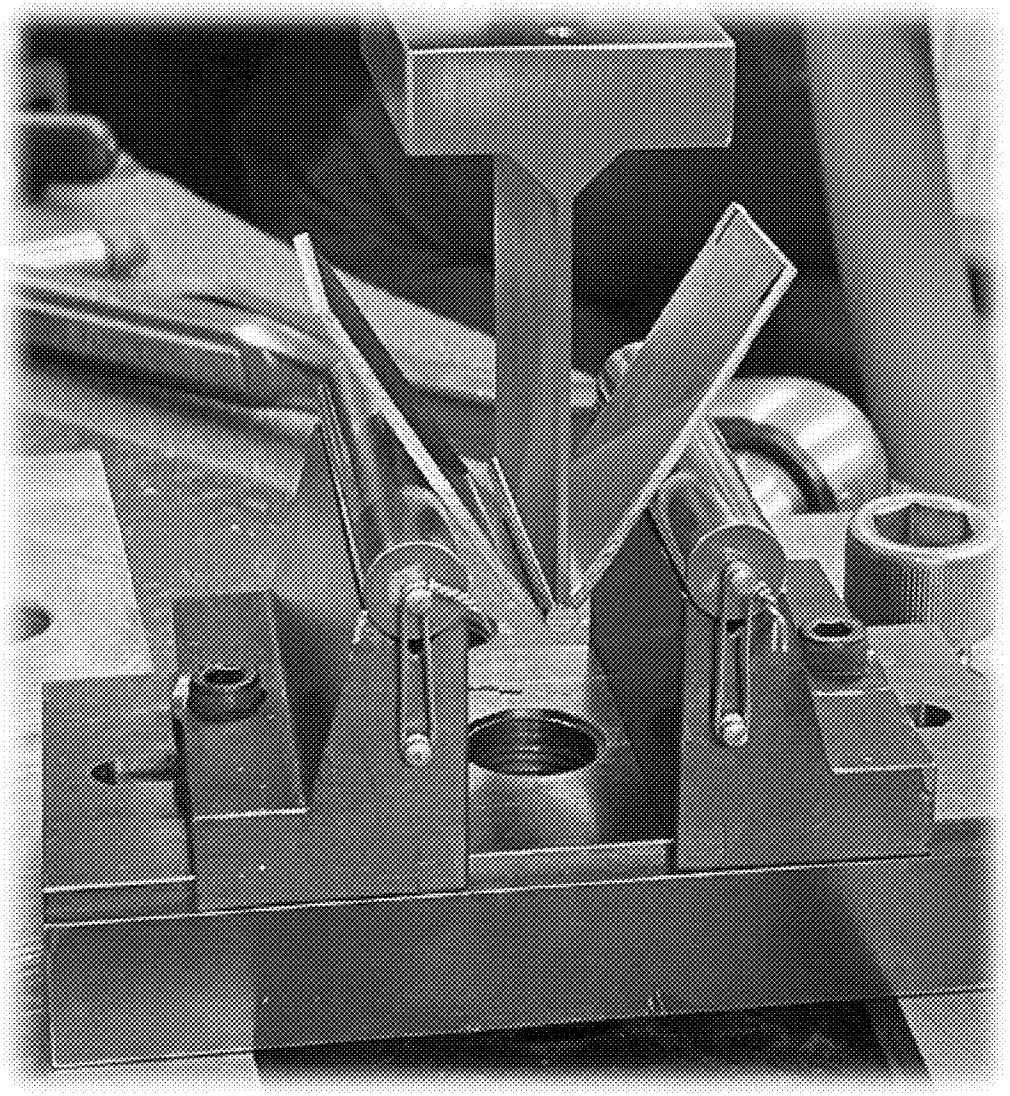
FIG. 20 depicts an example bend fabrication apparatus according to an embodiment of the disclosure.
Figure 19:
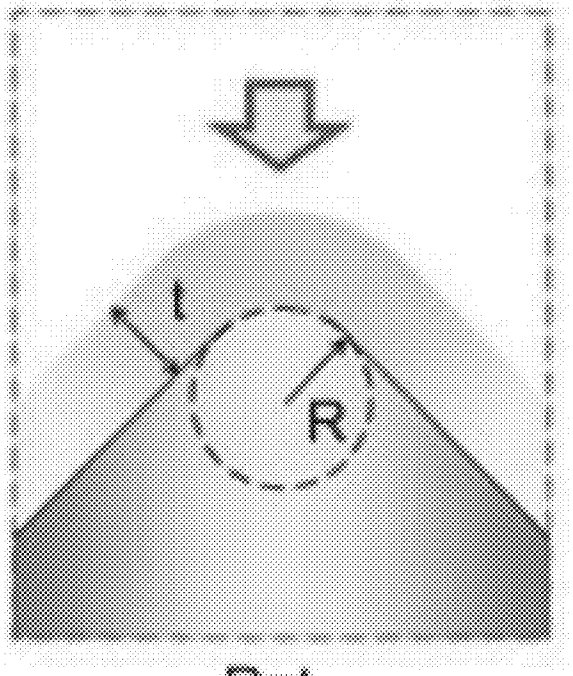
FIG. 19 depicts an example of a bend according to an embodiment of the disclosure.

Referring next to FIGS. 19 and 20, depicted are an example bend about a radius in FIG. 19 as well as an apparatus for providing a bend in FIG. 20. These are example configurations and are not necessarily the only bending configurations contemplated.

Figure 21:
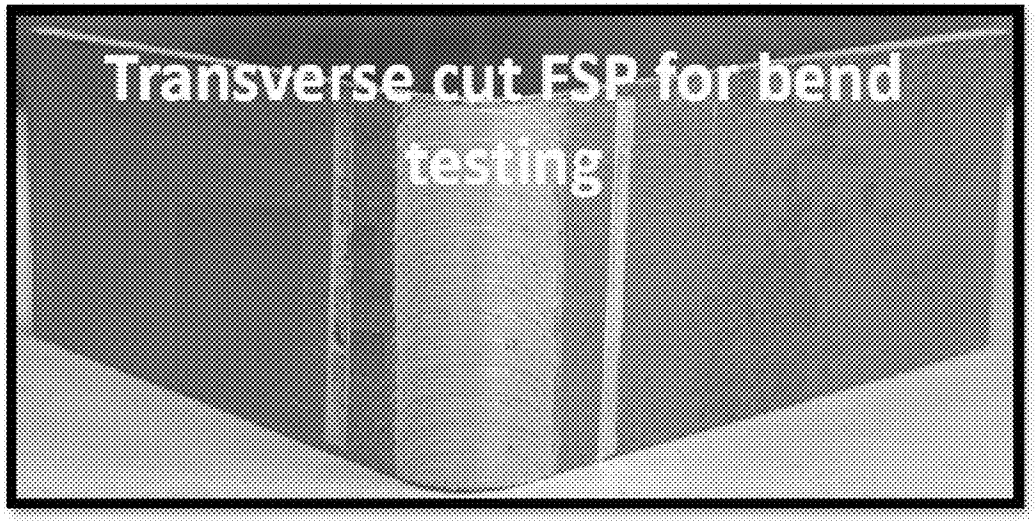
FIG. 21 depicts a transverse cut friction stir processed bend for testing according to an embodiment of the disclosure.
Figure 22:
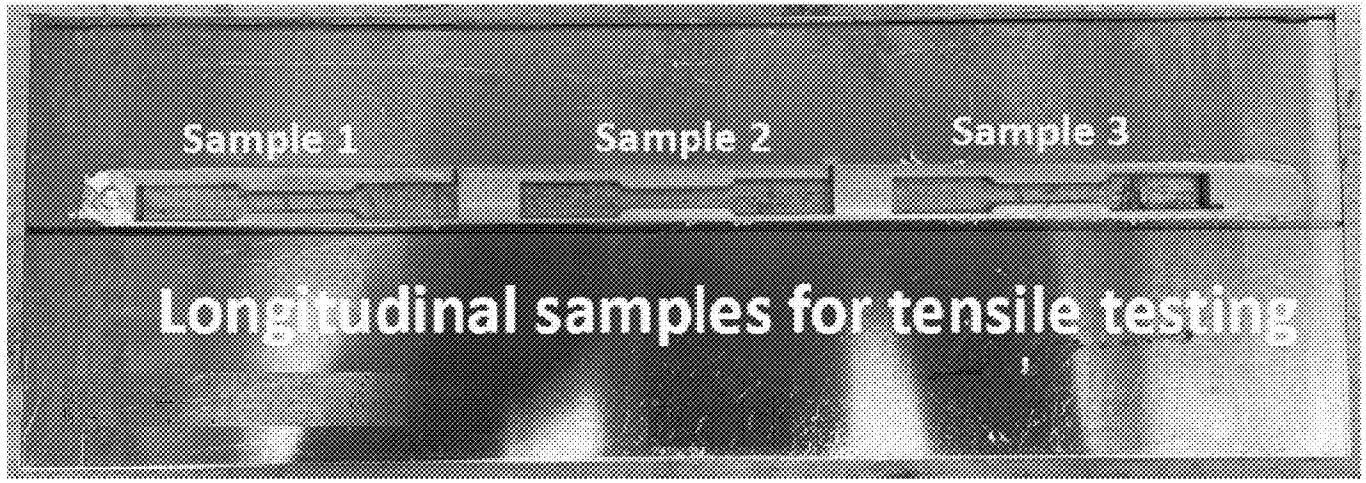
FIG. 22 depicts example samples for longitudinal tensile testing according to an embodiment of the disclosure.
Figure 23:
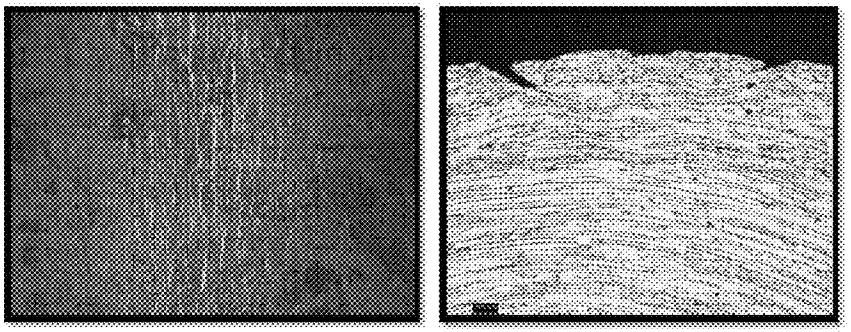
FIG. 23 depicts an outermost portion of bends of a sheet according to an embodiment of the disclosure.
Figure 24:
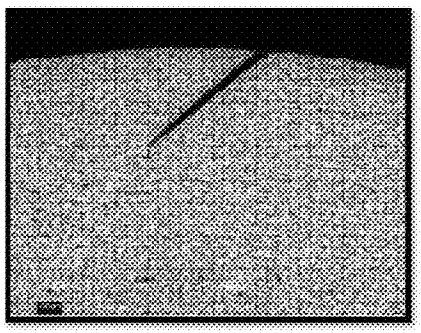
FIG. 24 depicts an outermost portion of bends of a sheet according to an embodiment of the disclosure.

In combination with FIG. 20, FIGS. 21 and 22 depict 90° and 180° bend tests according to ASTM E8 290, and many tensile tests are performed after local friction stir processing in discrete regions as shown in FIG. 22. As shown in FIG. 23, friction stir processing can provide 33% tighter radius prior to crack than base 7085-T76 (2 mm) as shown in FIG. 24. At FIG. 23, as shown the base metal cracks at an R/T ratio equal to 1.8, and in FIG. 24, the friction stir processed region or discrete processed modified region cracks at an R/T of 1.2.

Figure 25:
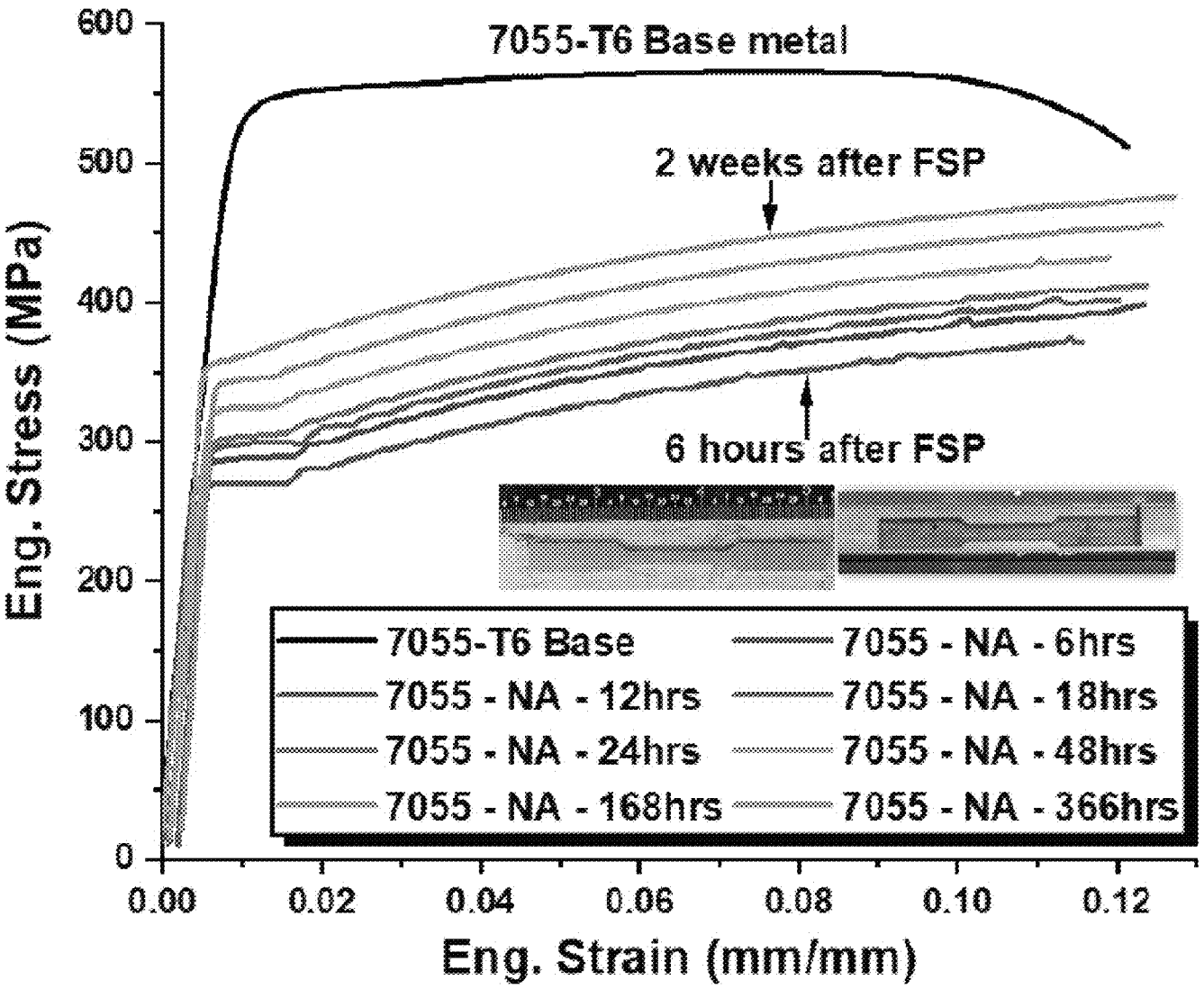
FIG. 25 depicts data associated with discrete region formability processing according to an embodiment of the disclosure.

Referring next to FIG. 25, as shown, yield strength improves over time after the modification of the discrete region using friction stir processing. Additionally, improved formability lasts for at least two weeks of room temperature aging after friction stir processing in certain implementations, as shown in the data of FIG. 25.

Figure 26:
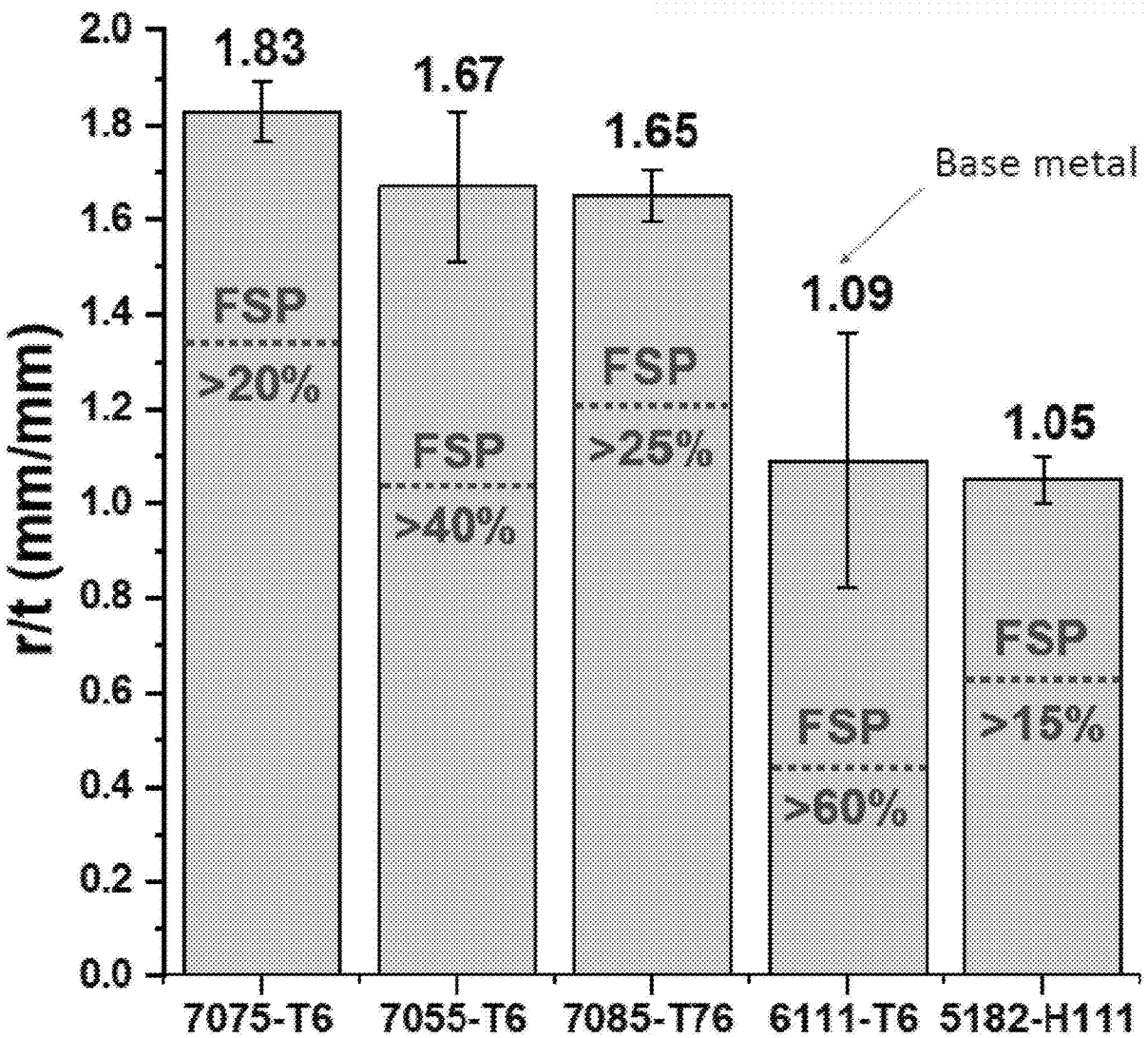
FIG. 26 depicts friction stir processing of aluminum sheets according to an embodiment of the disclosure.
Figure 28:
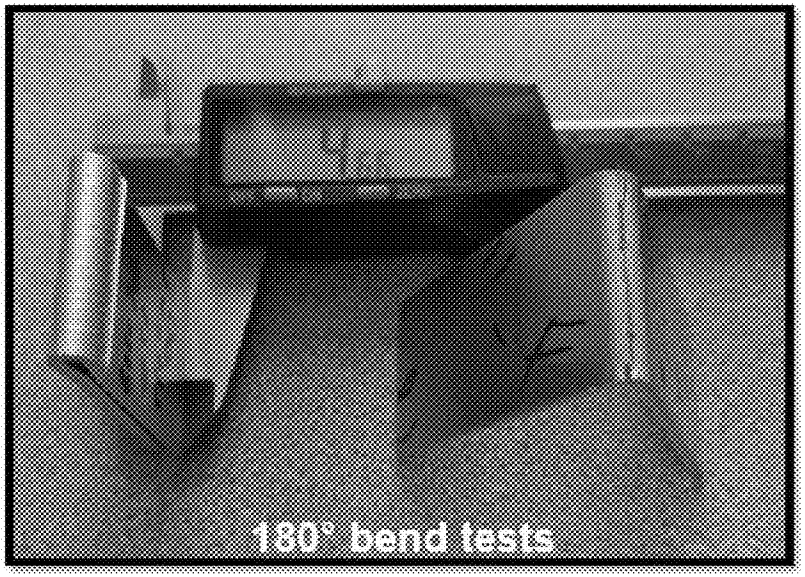
FIG. 28 depicts a 180° bend test according to an embodiment of the disclosure.
Figure 27:
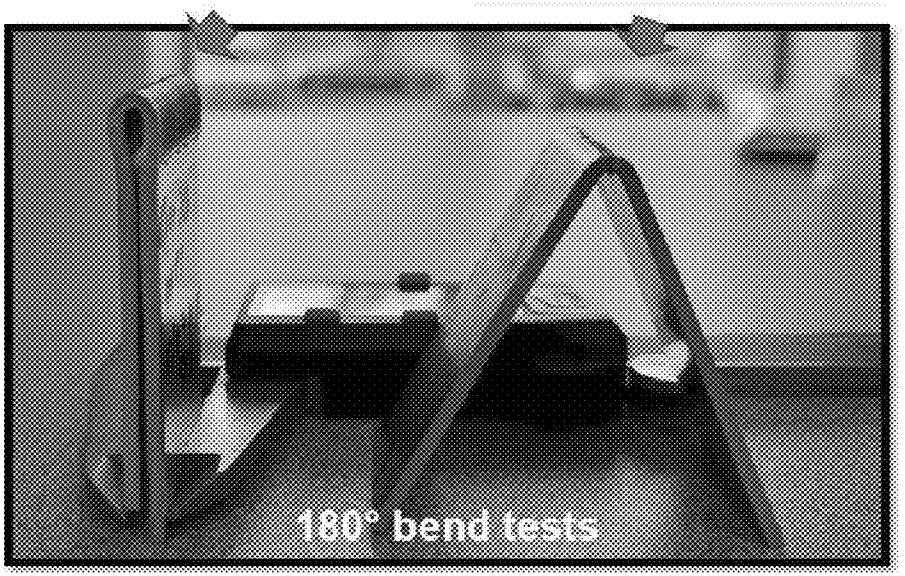
FIG. 27 depicts a 180° bend test according to an embodiment of the disclosure.
Figures 29, 30:
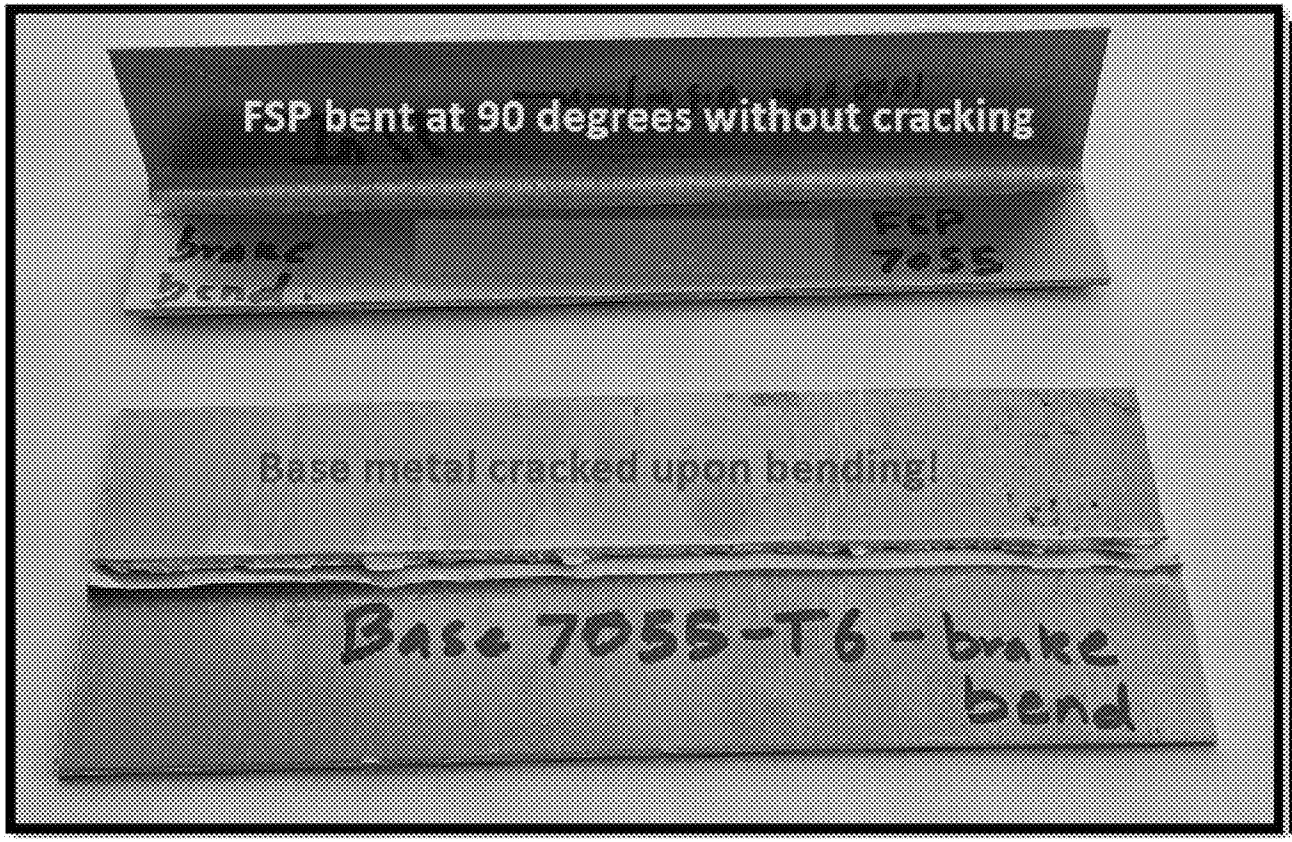
FIG. 29 depicts a friction stir processed bend without cracking according to an embodiment of the disclosure and also an example T6 without processing broken according to an embodiment of the disclosure.
FIG. 30 depicts a bent component according to an embodiment of the disclosure.

Referring next to FIG. 26, friction stir processed materials improved formability across alloy types. Particularly as shown in the data of FIG. 26, the bend tests show that FSP improves in formability over the base metal. In accordance with FIGS. 27-30, various alloy types are shown utilizing 180° bend tests and accordingly, as shown in FIG. 29, processed aluminum sheets bent at 90° without cracking. However, the base metal cracked upon bending, and as shown in a different view, FIG. 30 shown a clean bend along the modified discrete region.

Figure 31:
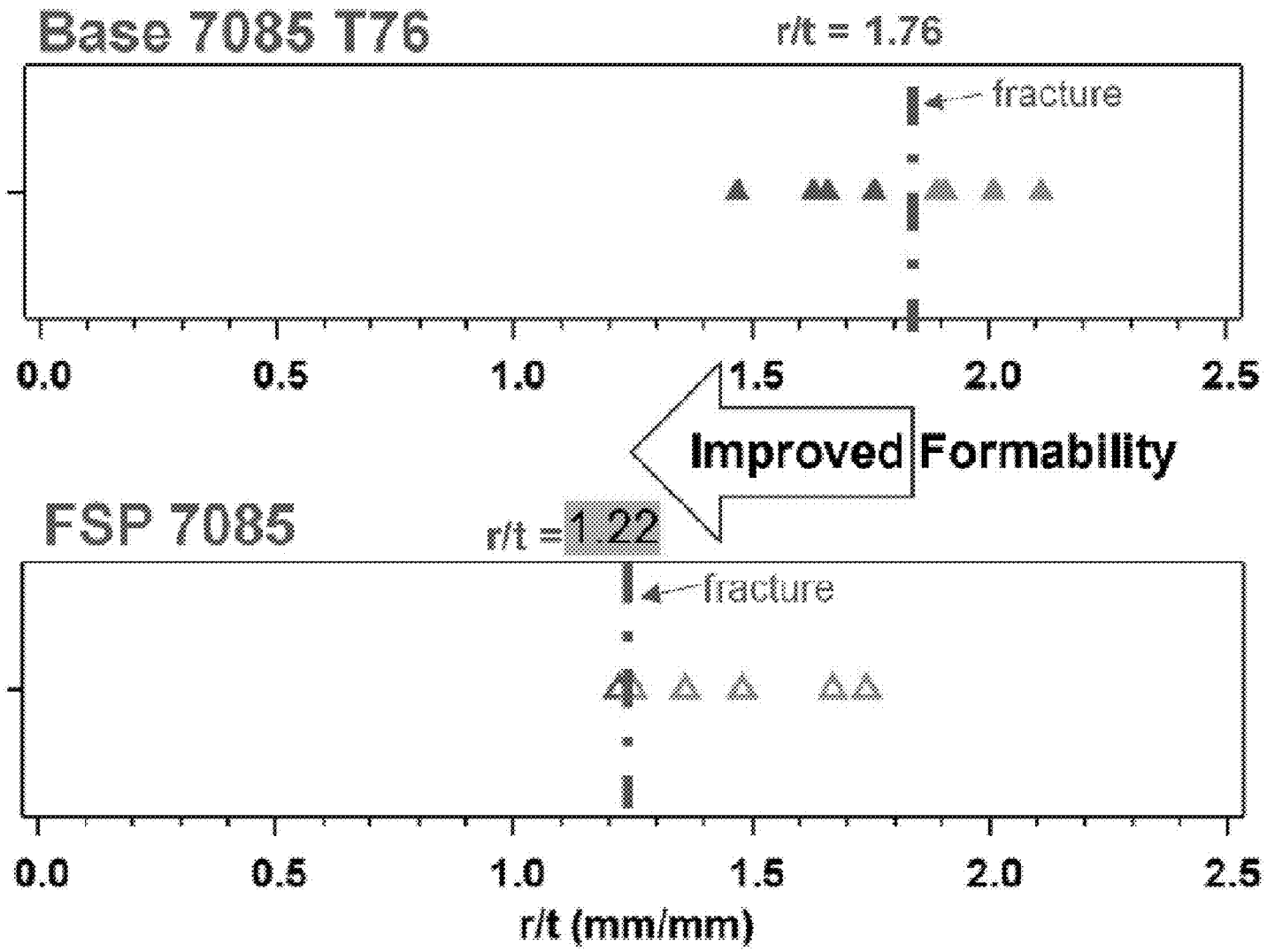
FIG. 31 depicts data associated with both unprocessed and friction stir processed aluminum sheet material according to an embodiment of the disclosure.

As shown in FIG. 31, data of a base tempered 76 material without a region is shown, and with another 7085 material that has been processed according to example implementations is shown. As can be seen, the red indicates failed samples, the green indicates pass samples, and a fracture line is established with a minimum r/t ratio at 1.76 for the base material, but decreases to 1.22 utilizing the improved and modified materials.

Figure 32:
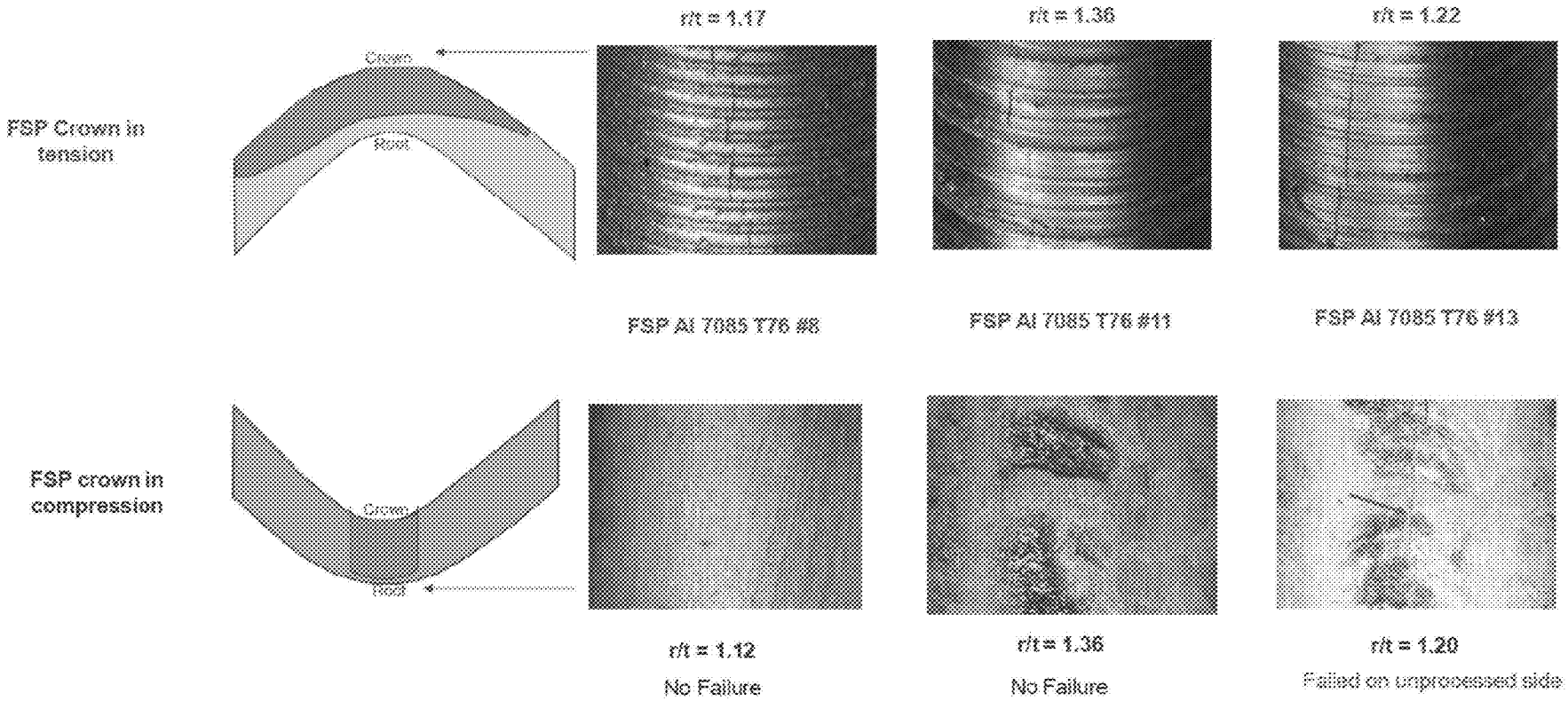
FIG. 32 depicts both the friction stir processed crown in tension and then also FSP processed material with a crown in compression.

Referring next to FIG. 32, the bend in relation to the modified region is shown, with crown in tension and with crown in compression, referring again to the bending as mentioned previously, causing a compression and/or an expansion. As can be seen, formability improves in both the bend directions.

Figure 33:
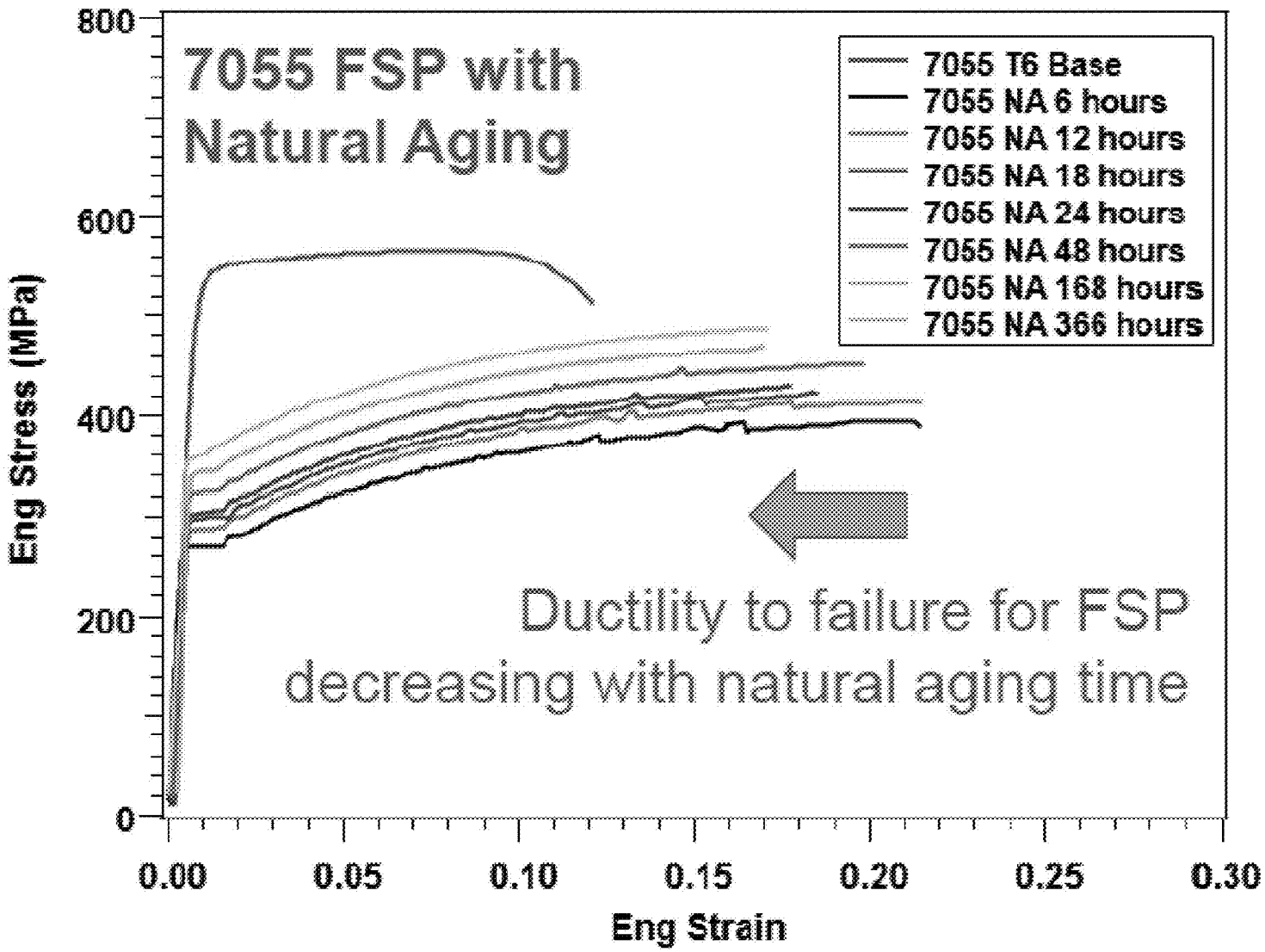
FIG. 33 depicts friction stir processing with natural aging data.

As shown in FIG. 33, natural aging of the friction stir processed regions was determined and a 2-week window of enhanced formability after friction stir processing was identified. This data is also shown in the table below. In accordance with the below Table 3, the r/t ratio showed a high sensitivity to natural aging time for 7055 and 7075 (not shown here). Also, friction stir processed 7085 and friction stir processed 6111 did not show any loss of formability, even after 3 months of natural aging.

TABLE 3

Bend Tests on Natural Aged Samples

| Alloy | R/T for Base Alloy Condition | R/T after Short Term Natural Aging | R/T after Long Term Natural Aging |
|---|---|---|---|
| FSP 7085 | 1.72 (T76) | 1.20 (6 hours) | 1.32 (3 months) |
| FSP 7055 | 1.80 (T6) | 1.02 (6 hours) | 1.85 (1 month) |
| FSP 6111 | 1.30 (T6) | 0.36 (6 hours) | 0.4 (3 months) |

Figure 34A:
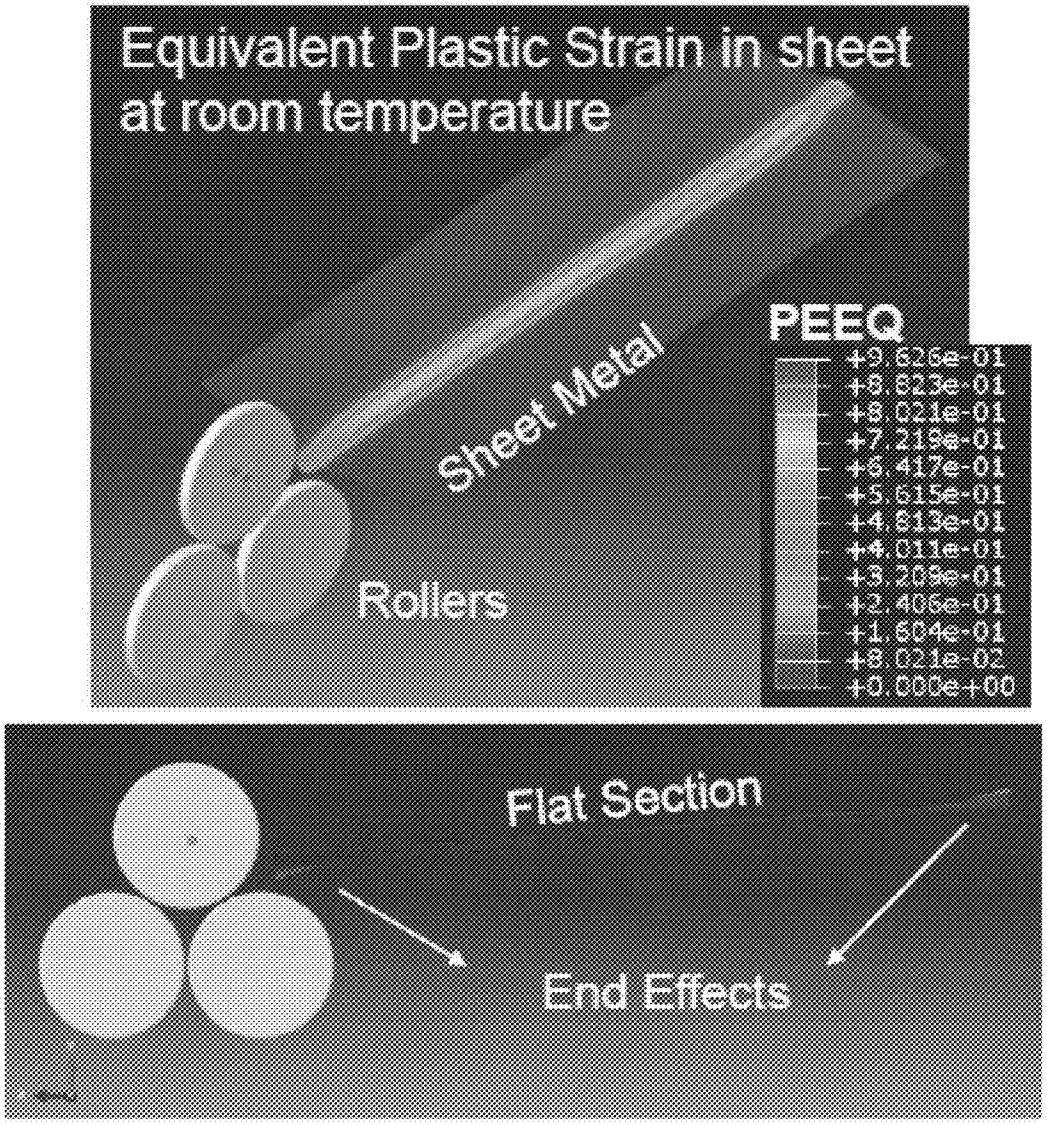
FIG. 34A depicts roller configurations as well as the amount of equivalent plastic strain at room temperature according to an embodiment of the disclosure.
Figure 34B:
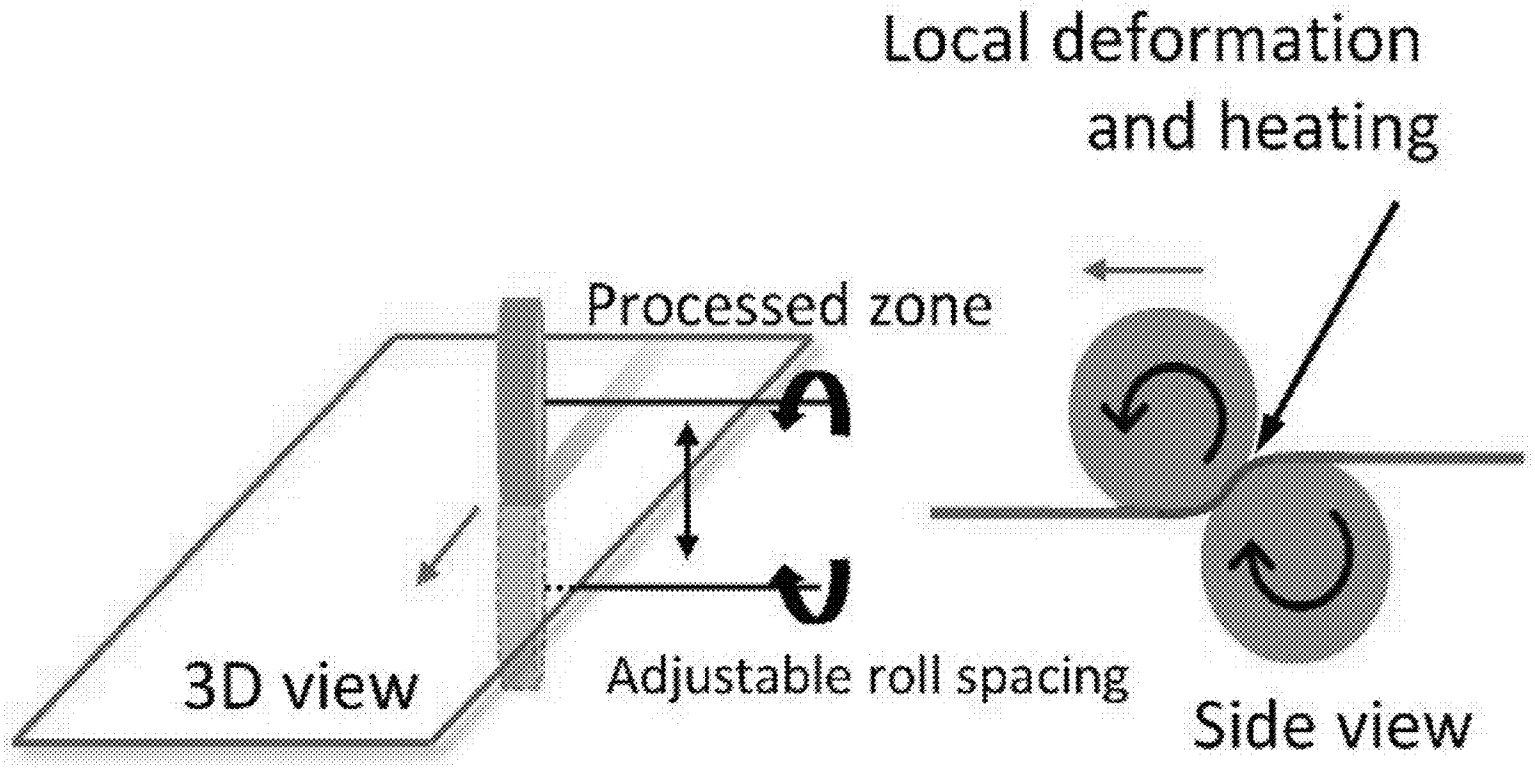
FIG. 34B is yet another roller configuration configured with heating according to an embodiment of the disclosure.

Referring next to FIG. 34A, in accordance with another example implementation of preparing modified discrete regions with aluminum sheets, roller bending and unbending as shown in the configuration of FIG. 34A can include a roller process, wherein the roller process is configured to provide a linear discrete roll or region within sheet metal. The process can include mechanical bending the sheet while heating the sheet in a very local narrow band of the sheet, for example. However, the process can also include bending the sheet during both cold bend and cold unbend, hot bend and cold unbend, hot bend and hot unbend, and then cold bend and hot unbend configurations. In accordance with example implementations in FIG. 34B, an alternative view of roller bending and unbending processes is depicted, with the orientation of the rollers as well as the local deformation and heating that takes place in the sheet. Also shown in FIG. 34B is an alternative implementation and more detailed view of the local roller bending and unbending of aluminum sheets utilizing the roller configuration as shown. Offset angles that are contemplated for the rollers include 15°, 20°, and 30°. The speed of the process can be at least 125 mm per second. Fraction indicates that the process zones include a width of about 4 mm to 2 mm roll thickness and demonstrates at least a 2 mm wide formability region on one or both sides of the sheet. Still on the rollers, the maximum angle between the rollers can be 45° which can give maximum deformation. In accordance with example implementations, in order to heat the sheets, electrical current can be passed through and heat the sheets in the specific deformation or formability regions depicted. Induction heating can also be used as an alternative to the electrical heating. This can result in very fine about 1 to 5 μm dynamically recrystallized grains in the process zone.

Figure 35:
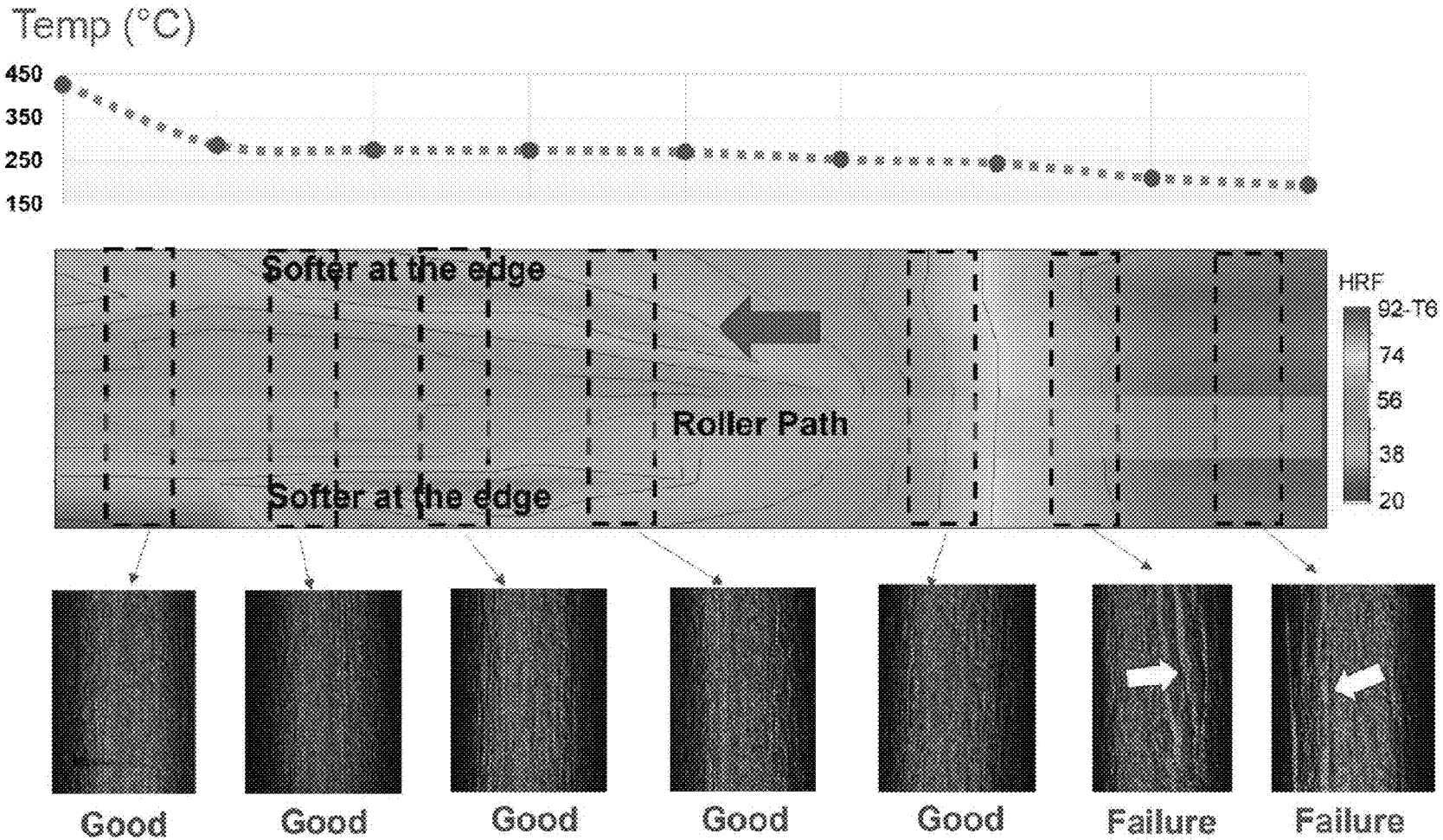
FIG. 35 depicts a temperature range along the roller path and subsequent samples extracted along the roller paths and then bent.
Figure 36:
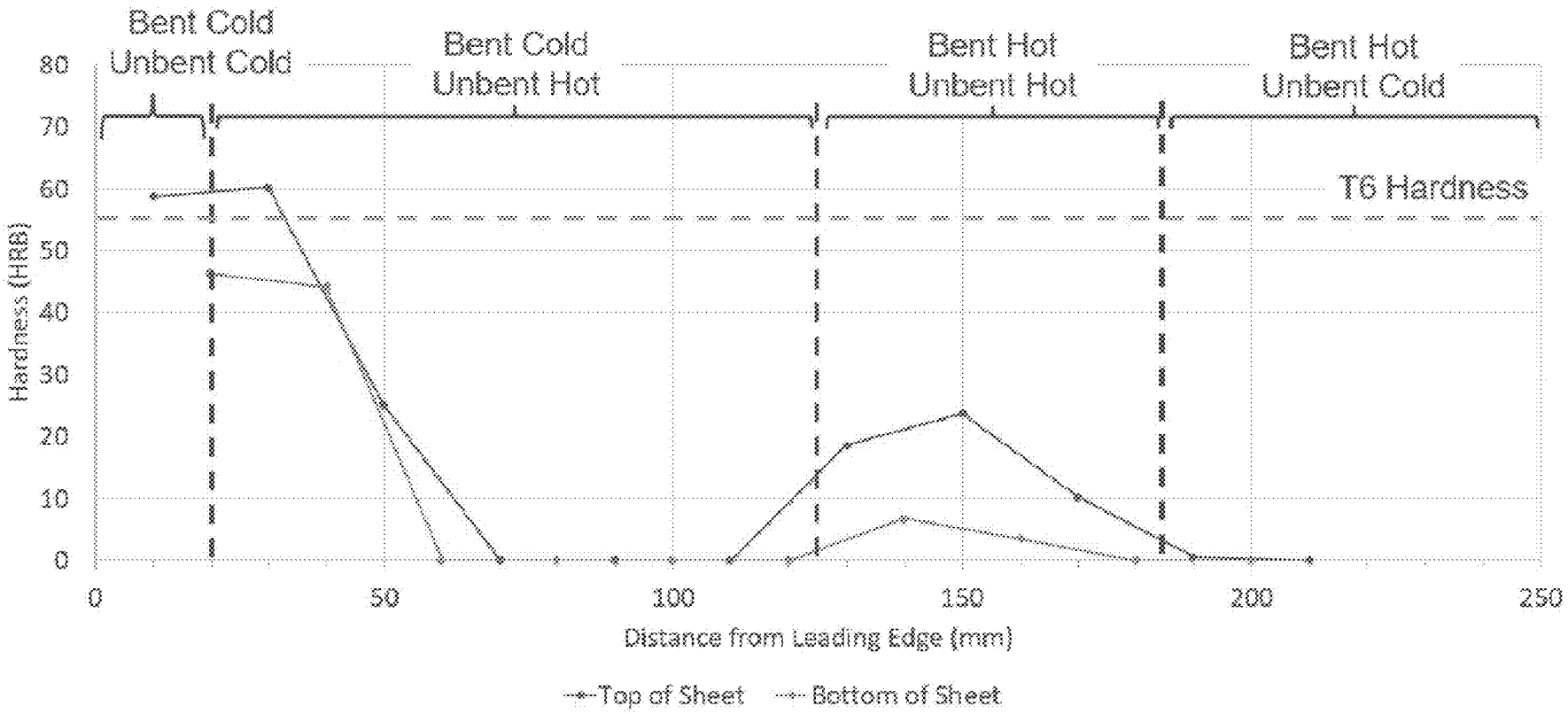
FIG. 36 depicts data acquired roller bending and unbending in both cold, roller bending and unbending in cold and hot, roller bending and unbending in hot and hot, and roller bending and unbending in hot and cold.
Figure 37:
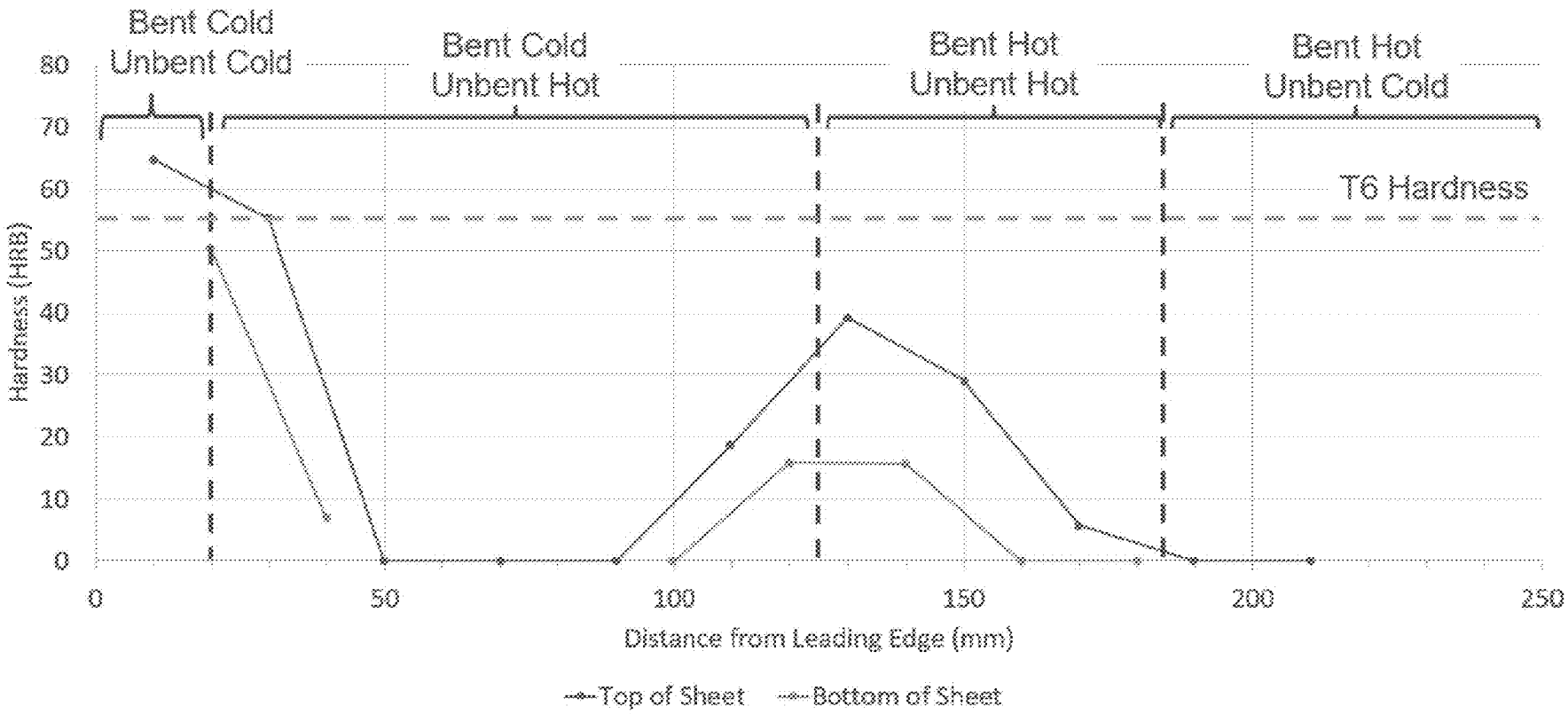
FIG. 37 depicts additional data in the same configurations as FIG. 36.

FIG. 35 depicts the data associated with the temperature and the roller path of materials as well as microstructure depictions of the materials that are modified under the roller path, and the roller path regions at different temperatures. As is shown in FIGS. 36 and 37, these roller bending and unbending of materials can be performed at different heat and/or cold configurations.

In accordance with FIG. 35, bending samples extracted along the sheet length show fracture for T6 hardness (red) unprocessed regions, but the processed (blue/green) regions have lower hardness, and therefore improved formability without any fracture. In accordance with example implementations, these materials can be developed into components, particularly for the automobile industry, that allow for the coupling of components around bent materials. Battery trays, for example, can be manufactured utilizing these techniques to form modified discrete regions and then bending along or about those modified discrete regions. In accordance with additional implementations wherein manufacturing takes place and materials are riveted together along a bend, for example, these materials can be preformed with these discrete regions, and the riveting along the bend can include the modified formability as described herein.

Figure 38:
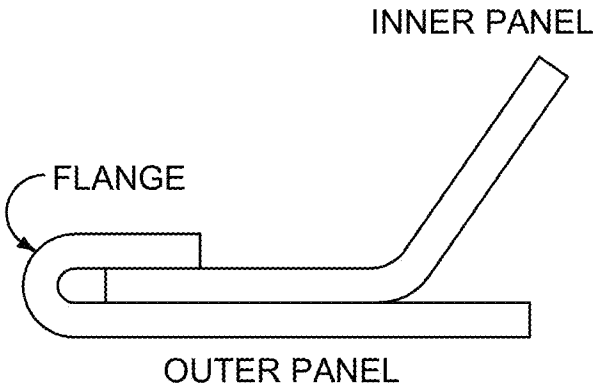
FIG. 38 depicts an example component that is hemmed to another sheet according to an embodiment of the disclosure.

FIG. 38 depicts an example fabricated component according to an example implementation, in the case, for the automobile industry, showing an inner panel and outer panel. In accordance with example implementations, the outer panel flange includes a bend that will have a modified formability region as disclosed in the present disclosure.

In accordance with example implementations, these processes and components have increased formability by obtaining dynamically recrystallized shear textured microstructures by local deformation and heating of age/work hardened sheets. These sheets retain most of the initial strength elsewhere of the processed region, without any further heat treatments. As well, manufacturing line integration through industrial robots by apparatus designs for roller bend-unbend and friction stir processing is contemplated.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. An aluminum sheet stamping process comprising:

heating an aluminum sheet to a first temperature that is greater than ambient temperature;

quenching the aluminum sheet to cool the aluminum sheet to a second temperature that is less than the first temperature;

after the quenching allowing the aluminum sheet to rest at ambient temperature for greater than 24 hours; and after resting, stamping the aluminum sheet to form a stamped component, wherein the stamped component comprises one or more portions having an HRB hardness greater than 87, the stamping being performed without additional softening after the resting.

2. The process of claim 1, wherein the first temperature is at least 450° C.

3. The process of claim 2, wherein the first temperature is between 450° C. and 540° C.

4. The process of claim 2, wherein the first temperature is between 480° C. and 490° C.

5. The process of claim 1, wherein the first temperature is maintained for at least 15 minutes.

6. The process of claim 1, wherein the aluminum sheet comprises an aluminum alloy.

7. The process of claim 1, wherein the second temperature is less than 30° C.

8. The process of claim 7, wherein the second temperature is between 18° C. and 30° C.

9. The process of claim 1, wherein the aluminum sheet is quenched with a fluid.

10. The process of claim 9, wherein the fluid comprises one or both of water and/or oil.

11. The process of claim 10, wherein the oil comprises mineral oil.

12. The process of claim 1, wherein the aluminum sheet is at least 0.7 mm in thickness.

13. The process of claim 12, wherein the aluminum sheet is between 0.7 and 4 mm in thickness.

14. The process of claim 1, wherein after the quenching allowing the aluminum sheet to rest at ambient temperature for at least 6 days.

15. The process of claim 1, wherein the stamping compresses and/or expands the aluminum sheet to form the one or more portions.

16. The process of claim 1, wherein the one or more portions having an HRB hardness greater than 87 are plastically deformed portions.

* * * * *